US005399977A

United States Patent [19]

Yoshizako et al.

[11] Patent Number: 5,399,977

[45] Date of Patent: Mar. 21, 1995

[54] MICROWAVE POWER SOURCE APPARATUS FOR MICROWAVE OSCILLATOR COMPRISING MEANS FOR AUTOMATICALLY ADJUSTING PROGRESSIVE WAVE POWER AND CONTROL METHOD THEREFOR

[75] Inventors: Yuji Yoshizako, Amagasaki; Michio Taniguchi, Kobe; Yuji Ishida, Nishinomiya, all of Japan

[73] Assignee: Daihen Corporation, Osaka, Japan

[21] Appl. No.: 180,691

[22] Filed: Jan. 13, 1994

Related U.S. Application Data

[63] Continuation of Ser. No. 888,884, May 26, 1992, abandoned.

[51] Int. Cl.[6] ..... H01P 5/04

[52] U.S. Cl. ..... 324/645; 455/123; 455/125; 455/193.2; 333/17.3; 324/642

[58] Field of Search ..... 455/125, 123, 121, 193.1, 455/193.2; 324/637, 638, 645; 333/17.3

[56] References Cited

U.S. PATENT DOCUMENTS

| | | | |
|---|---|---|---|
| 2,876,416 | 3/1959 | Vinding | 324/638 |
| 3,571,702 | 3/1971 | Hartner | 324/638 |
| 3,796,948 | 3/1974 | Wentworth | 324/638 |
| 4,335,469 | 6/1982 | Tharp et al. | 455/125 |
| 4,726,071 | 2/1988 | Jachowski | 455/125 |
| 5,016,565 | 5/1991 | Saitoh et al. . | |
| 5,079,507 | 1/1992 | Ishida et al. . | |

FOREIGN PATENT DOCUMENTS

| | | |
|---|---|---|
| 0058820 | 1/1982 | European Pat. Off. . |
| 0381398 | 1/1990 | European Pat. Off. . |

*Primary Examiner*—Kenneth A. Wieder
*Assistant Examiner*—Jose M. Solis
*Attorney, Agent, or Firm*—Scully, Scott, Murphy & Presser

[57] ABSTRACT

In a microwave power source apparatus for a microwave oscillator for generating a microwave, a DC power source supplies a DC power for generating the microwave to the microwave oscillator. A measuring section of a voltage standing wave detector is mounted on a microwave transmission line connected between the microwave oscillator and a microwave load, and measures either one of an impedance seen looking toward the microwave load at a mounted point thereof and a reflection coefficient thereat by detecting a voltage standing wave of the microwave being generated by the microwave oscillator and propagating on the microwave transmission line. A controller calculates a progressive wave power of the microwave propagating on the microwave transmission line from the microwave oscillator toward the microwave load based on either one of the impedance and the reflection coefficient measured by the measuring section, and controls the DC power source to adjust the progressive wave power of the microwave to a predetermined desirable adjustment value based on the calculated progressive wave power.

10 Claims, 13 Drawing Sheets

Motor driver
Motor driver
Motor driver
Voltage detector
Voltage detector
Voltage detector
A/D Conv.
A/D Conv.
A/D Conv.
Controller
Interface
D/A Conv.
D/A Conv.
High voltage power source circuit
Anode P-S
Control
AC-PS
DC-PS
Reference point
41c
41b
41a
40a
40b
40c
65
67a
67b
67c
69a
69b
50
30
15
14t
14h
14
13
32
31
M1
M2
M3
S1
S2
S3
Ps1
Ps2
Ps3
Pdc
Pdb
Pda
λg/4
λg/2
λg/6
D11
D12
D13
PR1
PR2
PR3
11
10
MG
C1
C2
L1
L2
T1
T2
T11
T12
T13
T14
9
SW21
SW22

High voltage power source circuit 1
Voltage det.
T11
7
Anode power source
T12
AC power source
T13
Control
T14
ON OFF
TR
M22
BR2
6
Current det.
DA
OFF
ON
INV2
OR2
CMP2
Vth2
34
Vth2 Gen.
Vth3
35
Vth3 Gen.
CMP3
M21
5
AMP
CMP1
4
OR1
Vth1
33
Vth1 Gen.
SW11
OFF
ON
INV1
BR1
Vset
8
Vset DC-PS
3
Noise filter
VR
69a
Vcc
Rp
SW1
2
Controller
D/A Conv
D/A Conv
50
69b

MICROWAVE POWER SOURCE APPARATUS FOR MICROWAVE OSCILLATOR COMPRISING MEANS FOR AUTOMATICALLY ADJUSTING PROGRESSIVE WAVE POWER AND CONTROL METHOD THEREFOR

This is a continuation of application Ser. No. 07/888,884, filed on May 26, 1992, now abandoned.

BACKGROUND OF THE INVENTION

1. Field of the Invention

The present invention relates to a microwave power source apparatus for a microwave oscillator and a control method therefor, and more particularly, to a microwave power source apparatus for a microwave oscillator comprising means for automatically adjusting a progressive wave power of a microwave outputted from the microwave oscillator to a predetermined desirable adjustment value, more precisely, and a control method therefor.

2. Description of the Prior Art

FIG. 15 shows a conventional microwave power source apparatus and peripheral units thereof.

Referring to FIG. 15, a microwave from a microwave oscillator 100 is outputted through an isolator 101 and a main rectangular waveguide 102*a* of a directional coupler 102 to a microwave load 110. The directional coupler 102 comprises the main rectangular waveguide 102*a* and a sub-rectangular waveguide 102*b* which are coupled with each other, and the sub-rectangular wave guide 102*b* comprises a rectangular waveguide 102*ba* for outputting a portion of the progressive wave of the microwave and a rectangular waveguide 102*bb* for outputting a portion of the reflected wave of the microwave. The end portion of the rectangular waveguide 102*ba* is terminated with a non-reflection resistive terminator 103, and the end portion of the rectangular waveguide 102*bb* is terminated with a non-reflection resistive terminator 104. A portion of the progressive wave of the microwave propagating in the rectangular waveguide 102*ba* is detected by a diode DI11, and the detected voltage signal is outputted to a voltage detector 111. On the other hand, a portion of the reflected wave of the microwave propagating in the rectangular waveguide 102*bb* is detected by a diode DI12, and the detected voltage signal is outputted to a voltage detector 112.

The voltage detector 111 detects and amplifies the inputted voltage signal, and outputs it to a linear correction circuit 131. Further, the voltage detector 112 detects and amplifies the inputted voltage signal, and outputs it to a linear correction circuit 132. Since the respective voltages detected by the diodes DI11 and DI12 are not directly proportional to the progressive wave power Pi and the reflected wave power Pr of the microwave propagating in the main rectangular waveguide 102*a* of the rectangular waveguide 102, respectively, the linear correction circuits 131 and 132 corrects the DC voltages outputted from the voltage detectors 111 and 112 so that the output voltages from the correction circuits 131 and 132 are directly proportional to the progressive wave power Pi and the reflected wave power Pr of the above-mentioned microwave. The corrected DC voltage from the linear correction circuit 131 is inputted to a DC voltmeter M11 for indicating the practical progressive wave power Pi and an inverted input terminal of an error amplifier AMP of a differential amplifier. On the other hand, the corrected DC voltage from the linear correction circuit 132 is inputted to a DC voltmeter M12 for indicating the practical reflected wave power Pr.

A DC power source 122 for setting a desirable progressive wave power comprises a variable resistor VR changes the output DC voltage thereof according to change in the resistance of the variable resistor VR, and outputs the DC voltage to a non-inverted input terminal of the error amplifier AMP. Further, the error amplifier AMP amplifies a difference voltage obtained by subtracting the DC voltage inputted to the inverted input terminal thereof from the DC voltage inputted to the non-inverted input terminal thereof, and outputs the amplified DC difference voltage as a control voltage through a driving amplifier DA to a high voltage DC power source circuit 120. The high voltage DC power source circuit 120 changes the current from a high voltage DC power source provided therein according to the inputted control voltage, and outputs the DC electric power of a relatively high voltage to the microwave oscillator 100 as a DC power for an anode power thereof. On the other hand, a DC power source circuit 121 supplies a DC electric power of a relatively low voltage to the microwave oscillator as a DC power for a heater thereof.

In the conventional microwave power source apparatus constituted as described above, the difference voltage between the DC voltage directly proportional to the progressive wave power Pi outputted from the linear correction circuit 131 and the DC voltage directly proportional to a desirable adjustment value of the progressive wave power set using the variable resistor VR and outputted from the DC power source 122 is amplified by the error amplifier AMP and the driving amplifier DA, and the amplified DC voltage is applied as the control voltage to the high voltage DC power source circuit 120. Then, the current of the high voltage DC power source for the anode voltage source supplied from the high voltage DC power source circuit 120 to the microwave oscillator 100 is controlled according to the control voltage.

In this feed-back control system, the progressive wave power of the microwave propagating from the microwave oscillator 100 in the main rectangular waveguide 102*a* of the directional coupler 102 is controlled so as to become the desirable adjustment value of the progressive wave power set using the variable resistor VR of the DC power source 122.

In other words, as shown in FIG. 16, an automatic output power adjusting process executed by the conventional microwave power source apparatus shown in FIG. 15 includes:

(a) step S101 of detecting the progressive wave and reflected wave voltages of the microwave by the directional coupler 102;

(b) step S102 of converting the detected progressive wave and reflected wave voltages into the DC voltage corresponding to the powers thereof by the linear correction circuits 131 and 132;

(c) step S103 of amplifying the difference voltage between the DC voltage corresponding to the progressive wave power and the set DC voltage corresponding to the desirable adjustment value of the progressive wave power by the error amplifier AMP and the driving amplifier DA; and (d) step S104 of controlling the anode current of the magnetron of the microwave oscillator 100 based on the amplified difference voltage.

However, in the above-mentioned microwave power source apparatus for controlling to adjust the progressive wave power of the microwave outputted from the microwave oscillator 100 into a predetermined desirable adjustment value, since there is used the directional coupler 102 in order to detect a portion of the progressive wave power of the microwave and a portion of the reflected wave power thereof, the size of the system including the microwave power source apparatus and the peripheral units thereof becomes relatively large, and then, the above-mentioned system can not be miniaturized.

On the other hand, there is disclosed in U.S. Pat. No. 5,079,507 an automatic microwave impedance adjusting apparatus for a microwave load connected to a microwave oscillator through a microwave transmission line, and an automatic microwave impedance adjusting method therefor. In the U.S. Patent, as shown in FIG. 17, the automatic microwave adjusting method includes:

(a) step S201 of inputting a desirable reflection coefficient $\Gamma s$ to be adjusted;

(b) step S202 of calculating an admittance $Ys=Gs+jBs$ corresponding to the desirable reflection coefficient $\Gamma s$ and an admittance $Ys'=Gs'+jBs'$ when the phase is inverted from the admittance $Ys$;

(c) step S203 of detecting DC voltages corresponding to the absolute values of the voltage standing wave $|Va|$, $|Vb|$ and $|Vc|$ using three probes located apart by $\lambda g/6$ from each other;

(d) step S204 of calculating a reflection coefficient $\Gamma o$ at a predetermined reference point based on the detected three DC voltages corresponding to the absolute values of the voltage standing wave;

(e) step S205 of calculating insertion lengths of three stubs to be inserted into a rectangular waveguide of the microwave transmission line which are located apart by $\lambda g/4$ from each other, based on the calculated reflection coefficient $\Gamma o$ and the inputted desirable reflection coefficient $\Gamma s$; and (f) step S206 of adjusting the impedance using at least two of the three stubs by inserting them by the calculated insertion lengths, respectively.

In FIG. 1 of the U.S. Patent, there is disclosed that the automatic microwave impedance adjusting apparatus comprises a power detector **10*d* for detecting a microwave power and a power controller 10*c* for controlling the microwave oscillator 10 to output a desirable output power based on the detected microwave power. However, since the microwave power in a rectangular waveguide 12** is detected and the output power is controlled based on the detected microwave power, in other words, since the output power is not controlled based on an accurate progressive wave power of the microwave propagating therein, the output power can not be controlled stably and precisely.

SUMMARY OF THE INVENTION

An object of the present invention is therefore to provide a microwave power source apparatus having a structure simpler than that of the conventional apparatus, capable of being miniaturized as compared with the conventional apparatus.

Another object of the present invention is to provide a microwave power source apparatus having a structure simpler than that of the conventional apparatus, capable of calculating a progressive wave power of a microwave propagating from a microwave power source toward a microwave load based on either one of a measured impedance and a measured reflection coefficient, and of more precisely adjusting the progressive wave power of the microwave to a predetermined desirable adjustment value.

A further object of the present invention is to provide a microwave power source apparatus capable of calculating a progressive wave power of a microwave propagating from a microwave power source toward a microwave load based on either one of a measured impedance and a measured reflection coefficient, of more precisely adjusting the progressive wave power of the microwave to a predetermined desirable adjustment value, and of further adjusting the impedance seen looking toward the microwave load to a predetermined desirable adjustment value.

A still further object of the present invention is to provide a method for controlling a microwave power source apparatus, capable of calculating a progressive wave power of a microwave propagating from a microwave power source toward a microwave load based on either one of a measured impedance and a measured reflection coefficient, for more precisely adjusting the progressive wave power of the microwave to a predetermined desirable adjustment value, and for further adjusting the impedance seen looking toward the microwave load to a predetermined desirable adjustment value.

In order to achieve the aforementioned objective, according to one aspect of the present invention, there is provided a microwave power source apparatus comprising:

a microwave oscillator for generating a microwave;

a microwave transmission line connected between said microwave oscillator and a microwave load;

power source means for supplying a DC power for generating said microwave to said microwave oscillator;

measuring means, mounted on said microwave transmission line, for measuring either one of an impedance seen looking toward said microwave load at a mounted point thereof and a reflection coefficient thereat by detecting a voltage standing wave of said microwave being generated by said microwave oscillator and propagating on said microwave transmission line;

calculating means for calculating a progressive wave power of said microwave propagating on said microwave transmission line from said microwave oscillator toward said microwave load based on either one of said impedance and said reflection coefficient measured by said measuring means; and control means for controlling said power source means to adjust said progressive wave power of said microwave to a predetermined desirable adjustment value based on said progressive wave power calculated by said calculating means.

In the microwave power source apparatus of the present invention, the progressive wave power of the microwave can be calculated without the conventional directional coupler 102, and also the progressive wave power of the microwave propagating in the microwave transmission line can be stably and more precisely adjusted to the predetermined desirable adjustment value based on the calculated progressive wave power. Therefore, the microwave power source apparatus of the present invention has a structure simpler than that of the conventional apparatus shown in FIG. 15, and also can be miniaturized and be made lighter as compared with the conventional apparatus.

According to another aspect of the present invention, there is provided a microwave power source apparatus comprising:

a microwave oscillator for generating a microwave;

a microwave transmission line connected between said microwave oscillator and a microwave load;

power source means for supplying a DC power for generating said microwave to said microwave oscillator;

measuring means, mounted on said microwave transmission line, for measuring either one of an impedance seen looking toward said microwave load at a mounted point thereof and a reflection coefficient thereat by detecting a voltage standing wave of said microwave being generated by said microwave oscillator and propagating on said microwave transmission line;

calculating means for calculating a progressive wave power of said microwave propagating on said microwave transmission line from said microwave oscillator toward said microwave load based on either one of said impedance and said reflection coefficient measured by said measuring means;

first control means for controlling said power source means to adjust said progressive wave power of said microwave to a predetermined desirable first adjustment value based on said progressive wave power calculated by said calculating means;

variable impedance means for changing an impedance to be connected to a mounted point thereof, said variable impedance means being mounted on said microwave load side of said measuring means on said microwave transmission line; and second control means for controlling said variable impedance means in response to either one of said impedance and said reflection coefficient measured by said measuring means so as to adjust said impedance seen looking toward said microwave load to a predetermined desirable second adjustment value.

The microwave power source apparatus can adjust the progressive wave power of the microwave to the predetermined desirable adjustment value more precisely, and also can stably and more precisely adjust the impedance seen at a predetermined reference point looking toward the microwave load to the predetermined desirable adjustment value. Further, when the desirable adjustment value of the impedance is set to an impedance seen at the predetermined reference point looking toward the microwave oscillator, the microwave power source apparatus can lead to an impedance matching state between the microwave oscillator and the microwave load on the microwave transmission line.

According to a further aspect of the present invention, there is provided a control method for a microwave power source apparatus comprising a microwave oscillator for generating a microwave, including the following steps of:

measuring either one of an impedance seen looking toward a microwave load at a mounted point thereof on a microwave transmission line connected between said microwave oscillator and said microwave load and a reflection coefficient thereat by detecting a voltage standing wave of said microwave being generated by said microwave oscillator and propagating on said microwave transmission line;

calculating means for calculating a progressive wave power of said microwave propagating on said microwave transmission line from said microwave oscillator toward said microwave load based on said measured either one of said impedance and said reflection coefficient;

controlling said power source means for supplying a DC power for generating said microwave to said microwave oscillator, so as to adjust said progressive wave power of said microwave to a predetermined desirable first adjustment value based on said calculated progressive wave power; and controlling variable impedance means for changing an impedance to be connected to a mounted point thereof mounted on said microwave load side of said measuring means on said microwave transmission line, in response to either one of said measured impedance and said measured reflection coefficient so as to adjust said impedance seen looking toward said microwave load to a predetermined desirable second adjustment value.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1:
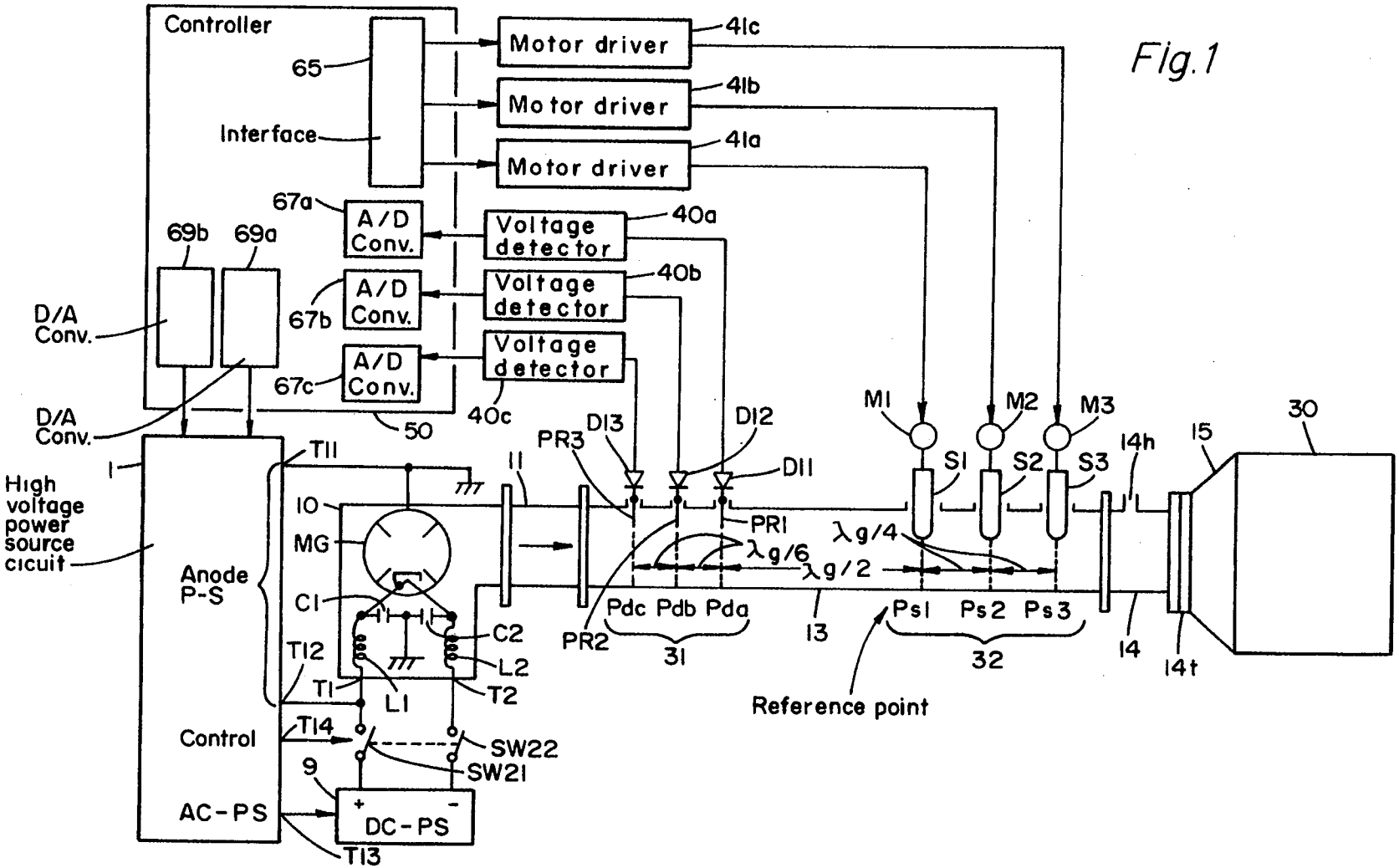
FIG. 1 is a schematic diagram showing a microwave power source apparatus for automatically adjusting a microwave output impedance of a microwave oscillator to a desirable impedance and automatically adjusting an output power thereof to a desirable output power.

The preferred embodiments according to the present invention will be described below with reference to the attached drawings.

A microwave power source apparatus for automatically adjusting a microwave output impedance of a microwave oscillator to a desirable impedance and automatically adjusting an output power thereof to a desirable output power, of a preferred embodiment according to the present invention will be described below, in the order of the following items, with reference to the attached drawings.

(1) Composition of Microwave power source apparatus
(2) High voltage power source circuit
(3) Controller and Peripheral units thereof
(4) Voltage standing wave detector
(5) Triple-stub tuner
(6) Action of Microwave power source apparatus
(7) Modifications It is to be noted that, in this specification, a normalized impedance and a normalized admittance which are given by dividing an impedance and an admittance at a point of a rectangular waveguide 13 by a characteristic impedance of the rectangular waveguide 13 are referred to as an impedance and an admittance hereinafter, respectively.

Figure 2:
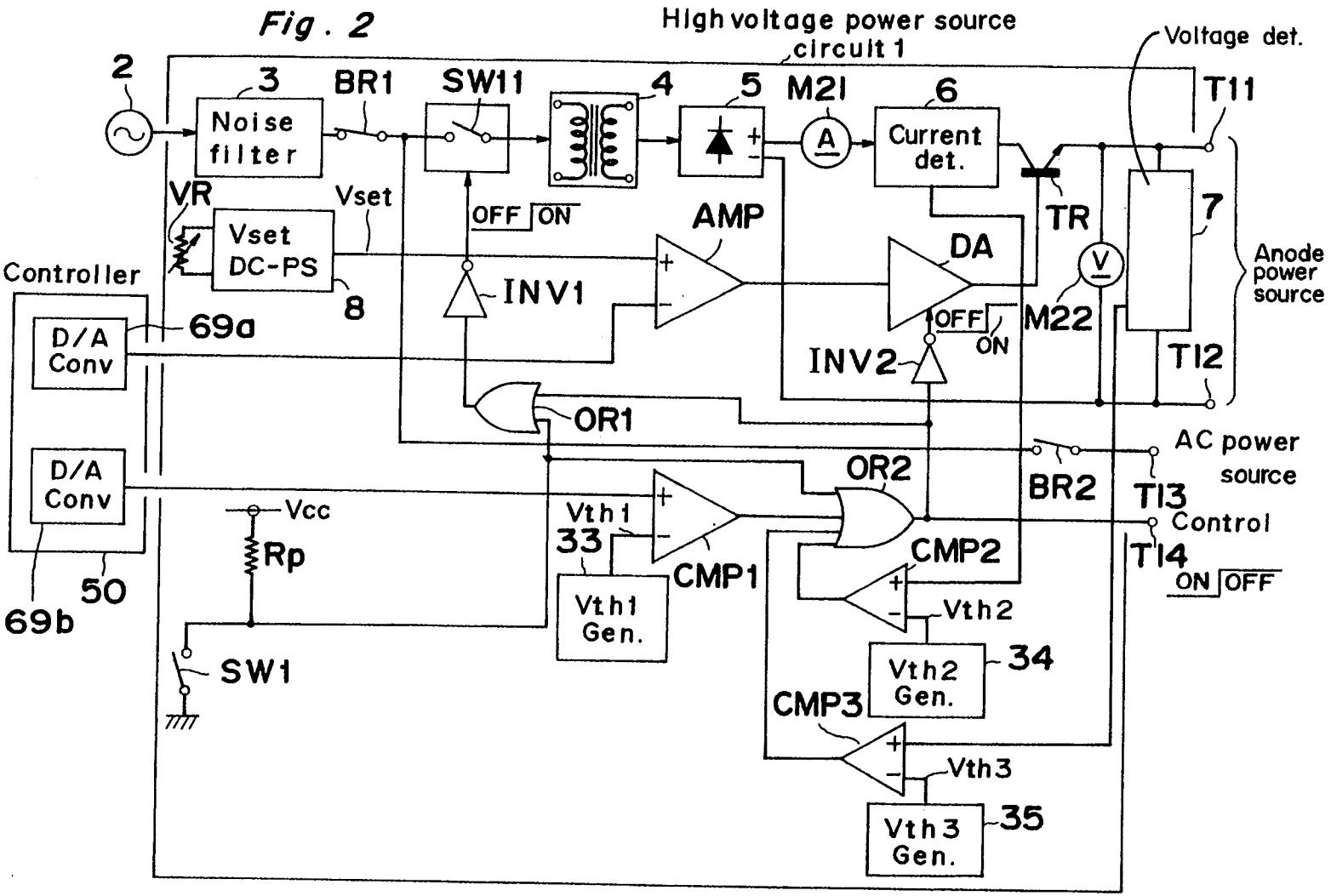
FIG. 2 is a schematic block diagram showing a high voltage power source circuit shown in FIG. 1.
Figure 3:
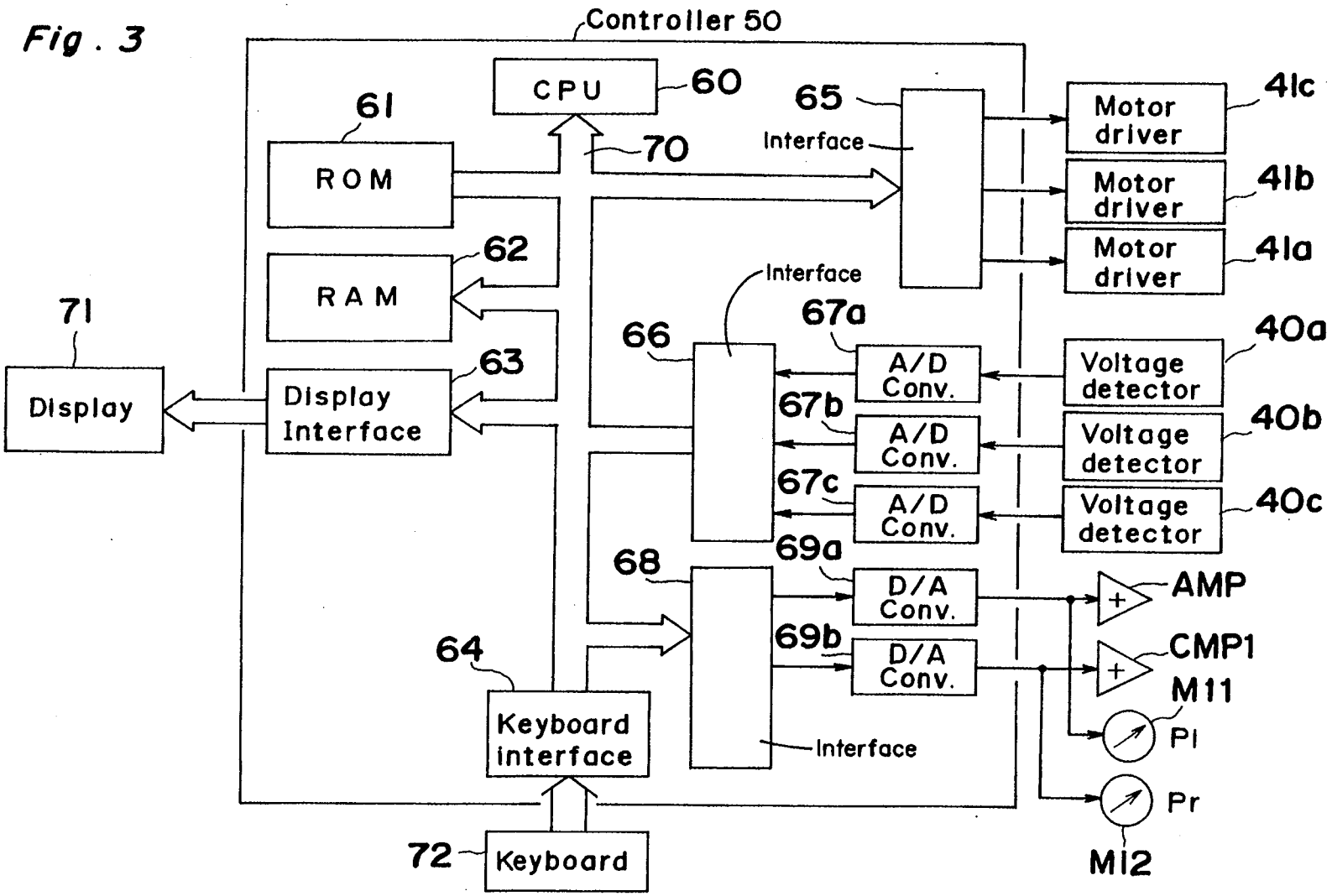
FIG. 3 is a schematic block diagram showing a controller and peripheral units thereof shown in FIG. 1.
Figure 15:
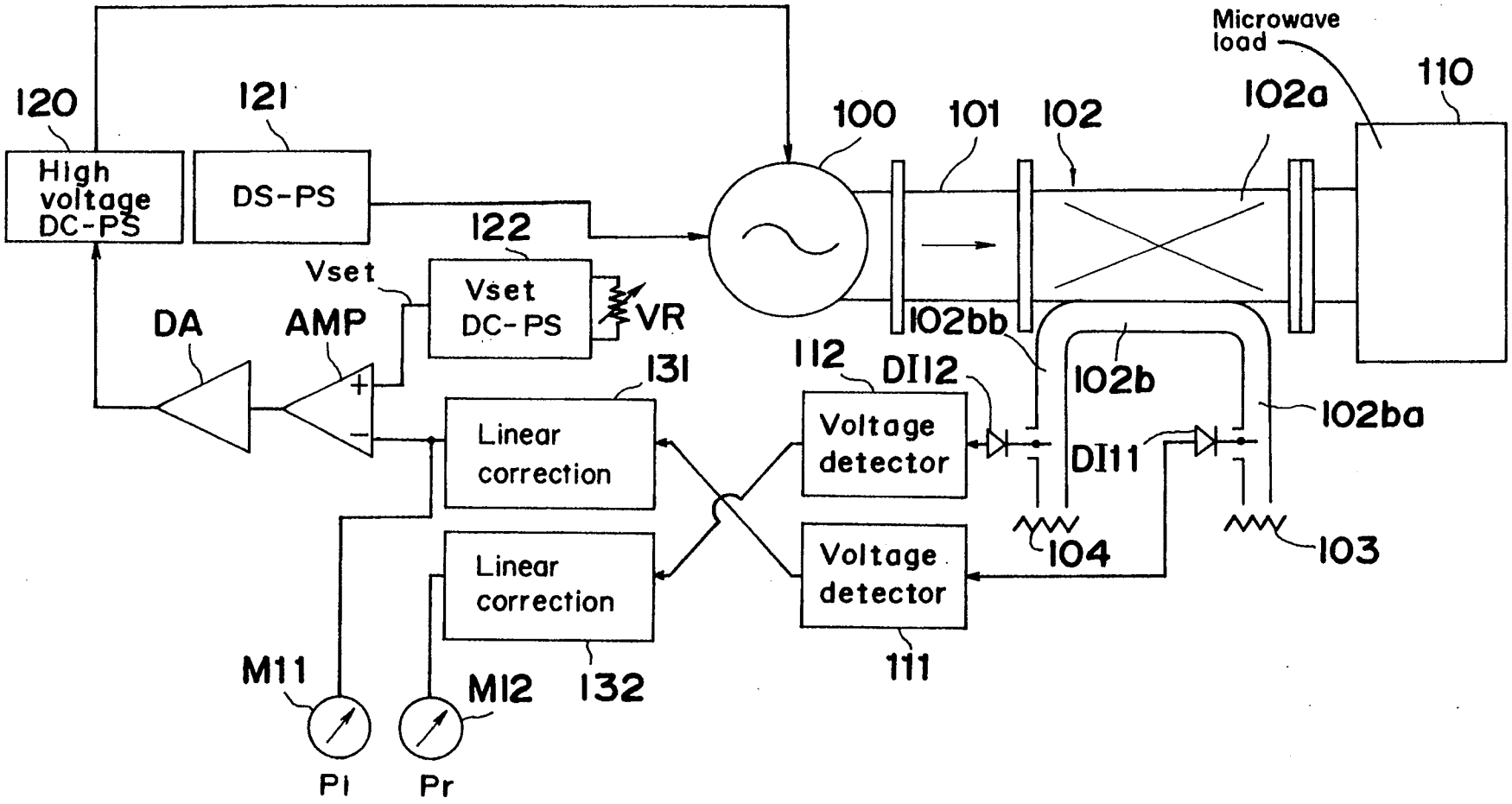
Fig. 15 PRIOR ART
FIG. 15 is a schematic diagram showing a conventional microwave power source apparatus.
Figure 16:
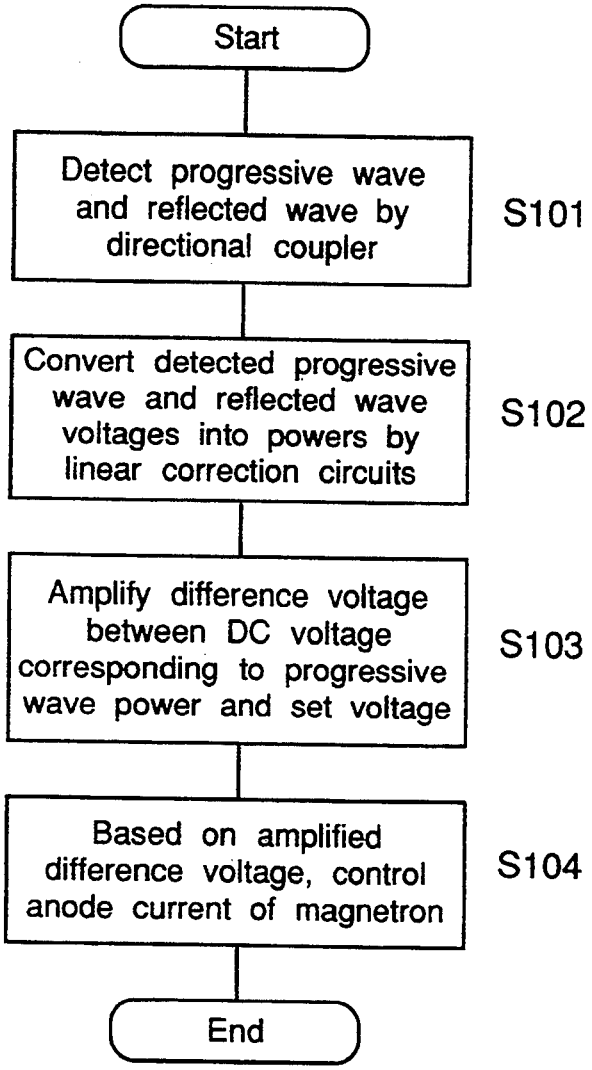
Fig. 16 PRIOR ART
FIG. 16 is a flow chart showing an automatic output power adjusting process executed by the conventional microwave power source apparatus shown in FIG. 15.
Figure 17:
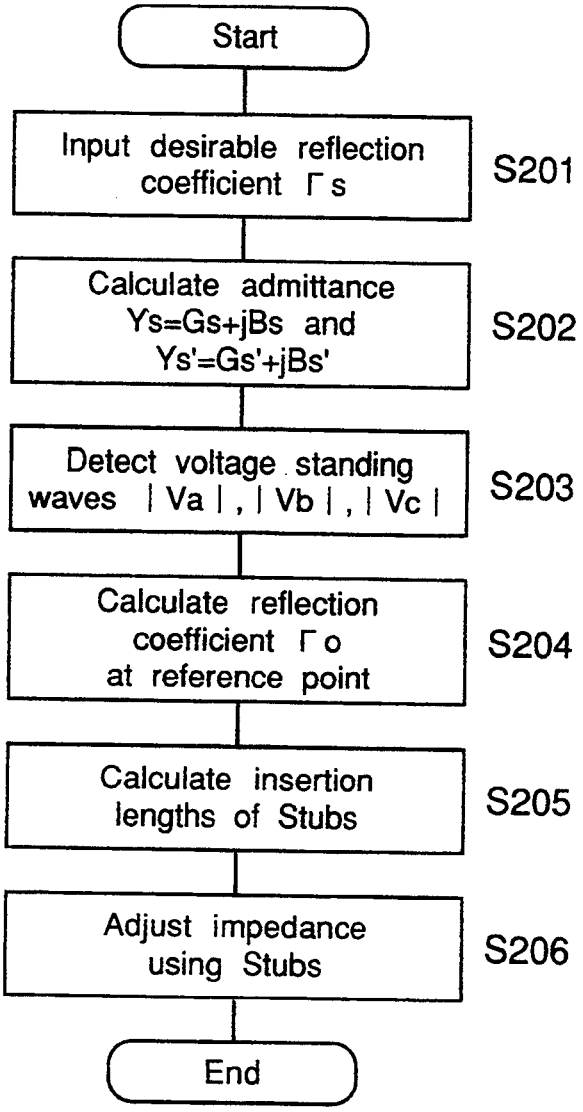
Fig.17 PRIOR ART
FIG. 17 is a flow chart showing a conventional automatic impedance adjusting process.

FIG. 1 shows the microwave power source apparatus of the preferred embodiment according to the present invention, FIG. 2 shows a high voltage power source circuit 1 shown in FIG. 1, and FIG. 3 shows a controller 50 shown in FIGS. 1 and 2 and the peripheral units thereof. It is to be noted that, in FIGS. 2 and 3, the same components as those shown in FIG. 15 are denoted the same numerals as those shown in FIG. 15.

The microwave power source apparatus of the present preferred embodiment mainly comprises a voltage standing wave detector 31, a triple-stub tuner 32, the controller 50, and the high voltage power source circuit 1.

The voltage standing wave detector 31 is composed of three probes PR1, PR2 and PR3 each probe detecting an amplitude of a voltage standing wave of a microwave propagating in the rectangular waveguide 13 which is connected between a microwave oscillator 10 and a plasma generating apparatus 30, and the voltage standing wave detector 13 is arranged on the microwave oscillator 10 side in the rectangular waveguide 13. The triple-stub tuner 32 is composed of three stubs S1, S2 and S3 each stub connecting an admittance in parallel to the transmission line of the rectangular waveguide 13 when driven by each of stepping motors M1, M2 and M3, and the triple-stub tuner 32 is arranged on the plasma generating apparatus 30 side in the rectangular waveguide 13.

The controller 50 calculates a reflection coefficient Γo at the probe PR1 of the voltage standing wave detector 31 from amplitudes of the voltage standing wave detected by the voltage standing wave detector 31, and calculates a desirable admittance Ys corresponding to a desirable reflection coefficient Γs which has been previously inputted using a keyboard 72. Then the controller 50 calculates insertion lengths of the stubs S1, S2 and S3 required for adjusting an admittance Yo seen looking toward a load of the plasma generating apparatus 30 at a mounted point Ps1 of the stub S1 mounted in the rectangular waveguide 13 (referred to as a reference point hereinafter) to the calculated desirable admittance Ys, and outputs driving signals for driving the stepping motors M1, M2 and M3 so that the stubs S1, S2 and S3 are inserted into the rectangular waveguide 13 by the above calculated insertion lengths, respectively. The controller 50 further calculates a progressive wave power Pi and a reflected wave power Pr of the microwave propagating in the rectangular waveguide 13 based on the amplitudes of the voltage standing wave detected by the voltage standing wave detector 31 and the calculated reflection coefficient Γo, and generates and outputs to the high voltage power source circuit 1, respective DC voltages directly proportional to the calculated progressive wave power Pi and the calculated reflected wave power Pr. The high voltage power source circuit 1 supplies an anode electric power to the microwave oscillator 10 so that the progressive wave power Pi of the microwave outputted from the microwave oscillator 10 becomes a previously set desirable progressive wave power based on the DC voltage directly proportional to the progressive wave power Pi inputted from the controller 50 and the above-mentioned desirable progressive wave power.

Then, the microwave power source apparatus of the preferred embodiment is characterized in automatically adjusting an impedance (referred to as a reference impedance hereinafter) Zo seen looking toward the plasma generating apparatus 30 at the reference point Ps1 to a desirable impedance Zs corresponding to the desirable reflection coefficient Γs inputted using a keyboard 72, and at the same time, automatically adjusting the progressive wave Pi of the microwave outputted from the microwave oscillator 10 to the above-mentioned adjustment value of the progressive wave power based on the amplitudes of the voltage standing wave detected by the voltage standing wave detector 31 and the calculated reflection coefficient Γo.

(1) Composition of Microwave Power Source Apparatus

Referring to FIG. 1, between the microwave oscillator 10 and the plasma generating apparatus 30, there are connected an isolator 11 for making a microwave outputted from the microwave oscillator 10 propagate toward only the plasma generating apparatus 30, the rectangular waveguide 13 in which there are mounted the voltage standing wave detector 31 and the triple-stub tuner 32, a rectangular waveguide 14 having a hole **14*h* formed for flowing cooling air thereinto, a taper waveguide 15 for transforming the TE10 mode which is the principal mode of the isolator 11 and the rectangular waveguides 13 and 14 into the TE11 mode which is the principle mode of a circular waveguide 15, in the order of the isolator 11, the rectangular waveguides 13 and 14 and the taper waveguide 15**, in the longitudinal direction thereof.

Further, the plasma generating apparatus 30 of a microwave load for performing an oxidation process for a high temperature superconducting oxide group is connected to a termination end of the taper waveguide 15. It is to be noted that a connection point of the rectangular waveguide 14 and the taper waveguide 15 is referred to as a load end 14*t* seen looking at the rectangular waveguide 13 of the microwave power source apparatus.

The microwave oscillator 10 comprises a magnetron MG, and two smoothing circuits for smoothing the DC power for a heater of the magnetron MG, wherein one smoothing circuit is composed of an inductor L1 and a capacitor C1, and another smoothing circuit is composed of an inductor L2 and a capacitor C2. Then, an anode power of a high DC voltage is supplied from the high voltage power source circuit 1 to the magnetron MG, and also a DC power is supplied from a DC power source circuit 9 to the heater of the magnetron MG. Namely, a first output terminal T11 of the anode power source of the high voltage power source circuit 1 is connected to an anode electrode of the magnetron MG of the microwave oscillator 10 and is connected to ground, and a second output terminal T12 thereof is connected to a first heater terminal T1 of the microwave oscillator 10.

The AC power supplied from an AC power source terminal T13 of the high voltage power source circuit 1 is applied to the DC power source circuit 9, which rectifies the applied AC power and performs a smoothing process for them, thereby generating and outputting a DC power for the heater of the magnetron MG through switches SW21 and SW22 to the first and second heater terminals T1 and T2 of the microwave oscillator 10. The switches SW21 and SW22 are controlled so as to interlock with each other according to a control signal outputted from a control signal terminal T14 of the high voltage power source circuit 1. In response to the control signal of a high level, the switches SW21 and SW22 are turned off. On the other hand, in response to the control signal of a low level, the switches SW21 and SW22 are turned on.

The first heater terminal T1 of the microwave oscillator 10 is connected through the inductor L1 to the cathode of the magnetron MG and the first terminal of the heater thereof, which is connected through the capacitor C1 to ground. Further, the second heater terminal T2 of the microwave oscillator is connected through the inductor L2 to the second terminal of the heater of the magnetron MG, which is connected through the capacitor C2 to ground.

The voltage standing wave detector 31 comprises three probes PR1, PR2 and PR3 which are mounted on the microwave oscillator 10 side in the rectangular waveguide 13. These probes PR1, PR2 and PR3 are mounted in the order of PR1, PR2 and PR3 from the microwave oscillator 10 side at equal spaces of $\lambda g/6$ in the longitudinal direction of the rectangular waveguide 13 in the center portion of the longitudinal side of the section thereof so as to project thereinto, wherein $\lambda g$ is a guide wavelength of the microwave propagating in the rectangular waveguide 13. Mounted points of the probes PR1, PR2 and PR3 in the longitudinal direction of the rectangular waveguide 13 are labeled Pda, Pdb and Pdc hereinafter, respectively.

The voltage standing wave of the microwave propagating in the rectangular waveguide 13 is detected by the diodes DI1, DI2 and DI3 which are respectively connected to the probes PR1, PR2 and PR3, and respective detection outputs thereof are inputted to voltage detectors 40*a*, 40*b* and 40*c*, respectively. The voltage detectors 40*a*, 40*b* and 40*c* detect the voltages of the detection outputs, and output detection signals indicating detected voltage levels to analogue to digital converters (referred to as A/D converters hereinafter) 67*a*, 67*b* and 67*c*, respectively.

The triple-stub tuner 32 comprises three stubs S1, S2 and S3 which are mounted on the plasma generating apparatus 30 side in the rectangular waveguide 13. These stubs S1, S2 and S3 are mounted in the order of S1, S2 and S3 from the microwave oscillator 10 side at equal spaces of $\lambda g/4$ in the longitudinal direction of the rectangular waveguide 13 in the center portion of the longitudinal side of the section thereof so as to be inserted into and drawn out from the rectangular waveguide 13 in a direction perpendicular to the longitudinal side of the section thereof. It is to be noted that the stub S1 is mounted at a mounted point Ps1 apart by a distance of $\lambda g/2$ in the longitudinal direction of the rectangular waveguide 13 from the mounted point Pda of the probe PR1 of the voltage standing wave detector 31. Mounted points of respective stubs S1, S2 and S3 are labeled Ps1, Ps2 and Ps3 in the longitudinal direction of the rectangular waveguide 13.

As described later, pulse signals indicating the insertion lengths or the drawing-out lengths of respective stubs S1, S2 and S3 to be inserted into or drawn out from the rectangular waveguide 13, and polarity signals indicating the insertion or the drawing-out operation thereof are outputted from an interface 65 of the controller 50 to respective motor drivers 41*a*, 41*b* and 41*c*. In response to these signals, the motor drivers 41*a*, 41*b* and 41*c* amplify the pulse signals, and output the amplified pulse signals having polarities indicated by the above polarity signals to the stepping motors M1, M2 and M3, respectively. The stepping motors M1, M2 and M3 respectively drive the stubs S1, S2 and S3 according to the pulse signals so as to insert them into the rectangular waveguide 13 by insertion lengths corresponding to the pulse numbers of the pulse signals, or draw out them therefrom by drawing-out lengths corresponding to the pulse numbers of the pulse signals.

(2) High Voltage Power Source Circuit

FIG. 2 shows the high voltage power source circuit 1 for supplying the anode power to the microwave oscillator 10 and for supplying the AC power to the DC power source circuit 9.

Referring to FIG. 2, a single-phase AC voltage of, for example, 200 volts is supplied from an AC power source 2 to the high voltage power source circuit 1, and the AC voltage is applied through a noise filter 3 of a low-pass filter, a breaker BR1 and a switch SW11 to a primary winding of a high voltage transformer 4. Further, the AC voltage is outputted from the output end of the breaker BR1 through another breaker BR2 and an AC power source terminal T13 to the DC power source circuit 9. The high voltage transformer 4 transforms the AC voltage of 200 volts applied to the primary winding thereof into the AC voltage of, for example, 2800 volts, and outputs the transformed AC voltage from the secondary winding thereof to a rectifier circuit 5, which is composed of four diodes connected in a bridge shape with each other. The rectifier circuit 5 full-wave-rectifies the inputted AC voltage, and outputs the rectified DC voltage of, for example, 3600 volts. The positive output terminal of the rectifier circuit 5 is connected through a DC ampere meter M21 and a current detector 6 to a collector of an NPN type transistor TR for a series regulator, an emitter of which is connected to one end of an ampere meter M22 for indicating a voltage applied as the anode power source, one end of a voltage detector 7 and the output terminal T11 of the anode power source. Further, the negative output terminal of the rectifier circuit 5 is connected through another end of the ampere meter M22, another end of the current detector 7 and the output terminal T12 of the anode power source.

The current detector 6 detects a DC current flowing therein which is supplied as the anode power source, and generates and outputs a DC voltage directly proportional to the detected DC current to a non-inverted input terminal of a comparator CMP2. A threshold voltage generator (Vth2 generator) 34 generates and outputs a predetermined DC threshold voltage Vth2 which is the same as the DC voltage outputted from the current detector 6 when the DC current of the anode power source flowing in the current detector 6 becomes a predetermined over-current value, to an inverted input terminal of the comparator CMP2. An output terminal of the comparator CMP2 is connected to a fourth input terminal of an OR gate OR2. The comparator CMP2 outputs a signal of the low level when the DC current of the anode power source flowing in the current detector 6 is equal to or smaller than the predetermined over-current value. On the other hand, the comparator CMP2 outputs a signal of the high level when the DC current thereof is larger than the predetermined over-current value.

Further, the voltage detector 7 detects the DC voltage of the anode power source which is applied across the voltage detector 7, and generates and outputs a DC voltage directly proportional to the detected DC voltage to a non-inverted input terminal of a comparator CMP3. A threshold voltage generator (Vth3 generator) 35 generates and outputs a predetermined DC threshold voltage Vth3 which is the same as the DC voltage outputted from the voltage detector 7 when the DC voltage of the anode power source applied across the voltage detector 7 becomes a predetermined over-voltage value, to an inverted input terminal of the comparator CMP3. An output terminal of the comparator CMP3 is connected to a third input terminal of the OR gate OR2. The comparator CMP3 generates and outputs a signal of the low level when the DC voltage of the anode power source applied to the voltage detector 7 is equal to or smaller than the predetermined over-voltage value. On the other hand, the comparator CMP3 generates and outputs the signal of the high level when the DC voltage thereof is larger than the predetermined over-voltage value.

A DC power source 8 for setting a progressive wave power comprises a variable resistor VR, changes the output DC voltage Vset thereof according to a change in the resistance of the variable resistor VR, and outputs the set output DC voltage Vset to a non-inverted input terminal of an error amplifier AMP of a differential amplifier. Data of the progressive wave power Pi calculated by the controller 50 as described in detail later are converted into an analogue DC voltage directly proportional to the above-mentioned progressive wave power Pi by a digital to analogue converter (referred to as a D/A converter hereinafter) 69*a*, and then, the converted DC voltage is inputted to an inverted input terminal of the error amplifier AMP. The error amplifier AMP subtracts the DC voltage inputted to the inverted input terminal thereof from the set DC voltage Vset inputted to the non-inverted input terminal thereof, amplifies the difference voltage of the subtraction result, and outputs the amplified difference voltage through a driving amplifier DA to a base of the transistor TR. The action of the driving amplifier DA is controlled according to a driving ON/OFF control signal inputted from the OR gate OR2 through an invertor INV2. In response to the driving ON/OFF control signal of the high level, the driving amplifier DA is enabled. On the other hand, in response to the driving ON/OFF control signal of the low level, the driving amplifier DA is disabled.

In the above-mentioned circuit comprising the DC power source 8, the error amplifier AMP, the driving amplifier DA and the transistor TR constituted as described above, the DC voltage directly proportional to the difference between the progressive wave power Pi of the microwave propagating in the rectangular waveguide 13 and the desirable progressive wave power set using the variable resistor VR is amplified and applied to the base of the transistor TR, thereby controlling the DC current of the anode power source flowing between the collector and the emitter of the transistor TR. Then, the DC current of the anode power source supplied to the magnetron MG of the microwave oscillator 10 is controlled, and the output power of the microwave or the progressive wave power thereof outputted from the magnetron MG is controlled.

In the feed-back control system of the present preferred embodiment, as described in detail later, the output power of the microwave outputted from the magnetron MG of the microwave oscillator 10 or the progressive wave power Pi of the microwave propagating in the rectangular waveguide 13 is controlled so as to become the desirable progressive wave power which has been previously set using the variable resistor VR of the DC power source 8.

Data of the reflected wave power Pr calculated by the controller 50 as described in detail later are converted into a DC voltage directly proportional to the above-mentioned reflected wave power Pr by a D/A converter 69*b* of the controller 50, and the converted DC voltage is are inputted to the non-inverted input terminal of the comparator CMP1. A threshold voltage generator (Vth1 generator) 33 generates and outputs a predetermined threshold voltage Vth1 which is the same as the DC voltage outputted from the D/A converter 69*b* when the reflected wave power Pr of the microwave propagating in the rectangular waveguide 13 becomes a predetermined over-reflected wave power value, to an inverted input terminal of the comparator CMP1. An output terminal of the comparator CMP1 is connected to a second input terminal of the OR gate OR2. The comparator CMP1 generates and outputs a signal of the low level when the reflected wave power Pr is equal to or smaller than the above-mentioned predetermined over-reflected wave power value. On the other hand, the comparator CMP1 generates and outputs the signal of the high level when the reflected wave power Pr is larger than the above-mentioned predetermined over-reflected wave power value.

SW1 denotes a switch for selecting or switching over whether or not the anode power from the high voltage power source circuit 1 and the DC power from the DC power source circuit 9 are outputted, namely, for selecting whether or not the microwave from the microwave oscillator 10 is to be outputted. One end of the switch SW1 is connected to ground, and another end thereof is connected through a pull-up resistor Rp to the DC power source Vcc. Further, another end of the switch SW1 is connected to a second input terminal of an OR gate OR1 and a first input terminal of the OR gate OR2. The control signal outputted from the OR gate OR2 is inputted through the control signal output terminal T14 to respective control signal input terminals of the switches SW21 and SW22, and is also inputted through the invertor INV2 to the control signal input terminal of the driving amplifier DA. Further, the control signal outputted from the OR gate OR2 is inputted to a first input terminal of the OR gate OR1. A control signal outputted from the OR gate OR1 is inputted through an invertor INV1 to a control signal input terminal of the switch SW11.

In the high voltage power source circuit 1 constituted as described above, when the switch SW1 is turned off, the control signal inputted to the switch SW11 has the low level, the control signal outputted from the OR gate OR2 has the high level, and the control signal inputted to the driving amplifier DA has the low level, thereby disabling the driving amplifier DA. Then, since the control signal of the high level is inputted to the respective switches SW21 and SW22, both the switches SW21 and SW22 are turned off. In this case, the microwave is not outputted from the microwave oscillator 10.

On the other hand, in the case where the switch SW1 is turned on, when at least one of the following three abnormal conditions (referred to as three abnormal conditions hereinafter) is effected:

(a) the reflected wave power Pr is larger than the predetermined over-reflected wave power value;

(b) the DC current of the anode power source flowing in the current detector 6 is larger than the predetermined over-current value; and (c) the DC voltage of the anode power source applied to the voltage detector 7 is larger than the predetermined over-voltage value, the control signal inputted to the switch SW11 has the low level, thereby turning off the switch SW11. At the same time, the control signal outputted from the OR gate OR2 has the high level, and the control signal inputted to the driving amplifier DA has the low level, thereby disabling the driving amplifier DA. Further, in this case, since the control signal of the high level is inputted to the switches SW21 and SW22, both the switches SW21 and SW22 are turned off. Therefore, the microwave is not outputted from the microwave oscillator 10.

Further, in the case where the switch SW1 is turned on, when all the three abnormal conditions are not effected, the control signal inputted to the switch SW11 has the high level, thereby turning on the switch SW11. At the same time, the control signal outputted from the OR gate OR2 has the low level and the control signal inputted to the driving amplifier DA has the high level, thereby enabling the driving amplifier DA. In this case, since the control signal of the low level is inputted to the switches SW21 and SW22, both the switches SW21 and SW22 are turned on. Therefore, the microwave is outputted from the microwave oscillator 10, and also there is performed the process for automatically adjusting the progressive wave power into the desirable adjustment value thereof.

FIG. **14*b* is a flow chart showing the process for automatically adjusting the progressive wave power into the desirable adjustment value thereof which is executed by the high voltage power source circuit 1**.

Referring to FIGS. 2 and **14*b*, first of all, the DC voltage corresponding to the calculated progressive wave power Pi is inputted to the non-inverted input terminal of the error amplifier AMP of the differential amplifier at step S11, and then, the difference voltage between the DC voltage inputted at step S1 and the set DC voltage Vset outputted from the DC power source 8 after being set using the variable resistor VR is amplified at step S12 by the error amplifier AMP of the differential amplifier at step S12. Thereafter, at step S13, the amplified different voltage is applied through the driving amplifier DA to the base of the transistor TR, and based on the amplified difference voltage, the current of the anode power source supplied to the anode of the magnetron MG is controlled so as to control the progressive wave power Pi of the microwave outputted from the magnetron MG. Thereafter, the control flow goes to step S11, and the above-mentioned processes of steps S11 to S13** are executed.

In the above-mentioned feed-back system constituted by the controller 50 and the high voltage power source circuit 1, the progressive wave power Pi is controlled so as to be adjusted into the desirable adjustment value thereof which is set using the variable resistor VR of the DC power source 8.

(3) Controller and Peripheral Units Thereof

FIG. 3 shows the controller 50 and the peripheral units thereof, which are provided for executing an automatic impedance adjustment process and for calculating the progressive wave power Pi and the reflected wave power Pr of the microwave and outputting data thereof.

Referring to FIG. 3, the controller 50 comprises a CPU 60 for executing the automatic impedance adjusting process of the microwave power source apparatus, a ROM 61 for storing a system program for executing the process of the CPU 60 and data required for executing the above system program, and a RAM 62 used as a working area and storing data required in the processing of the CPU 60.

The controller 50 further comprises a display interface 63 connected to a display 71, a keyboard interface 64 connected to the keyboard 72, the A/D converters **67*a*, 67*b* and 67*c*, an interface 66 connected to the A/D converters 67*a*, 67*b* and 67*c*, an interface 65 connected to the motor drivers 41*a*, 41*b* and 41*c*, the D/A converters 69*a* and 69*b*, and an interface 68 connected to the D/A converters 69*a* and 69*b*. In the controller 50, the CPU 60, the ROM 61, the RAM 62, the display interface 63, the keyboard interface 64 and the interfaces 65, 66 and 68 are connected to each other through a bus 70**.

Respective analogue detection signals outputted from the voltage detectors **40*a*, 40*b* and 40*c* are A/D converted to digital data, and then, the digital data are transferred to the RAM through the interface 66 and the bus 70, and are stored therein. Since digital data of the respective detection signals stored in the RAM 62 are not directly proportional to the amplitudes |Va|, |Vb| and |Vc| of the practical voltage standing wave due to non-linear characteristics of the diodes DI1, DI2 and DI3, a liner correction process known to those skilled in the art is performed for the above-mentioned data by the CPU 60 so as to obtain data indicating the amplitudes |Va|, |Vb| and |Vc| of the practical voltage standing wave, and then, the obtained data are stored in the RAM 62**.

The CPU 60 calculates the absolute value |Γo| of the reflection coefficient Γo at the reference point and the phase θ thereof based on the data obtained by the above-mentioned linear correction process and the desirable reflection coefficient Γs previously inputted using the keyboard 72, and thereafter, the CPU 60 calculates data of the insertion lengths or the drawing-out lengths of respective stubs S1, S2 and S3 required for adjusting the reference impedance Zo seen looking toward the load at the reference point Ps1 to the above desirable impedance Zs based on the digital data of the detection signals and the inputted desirable reflection coefficient Γs, and outputs the calculated data and data indicating the insertion or the drawing-out operation of respective stubs S1, S2 and S3, to the interface 65 through the bus 70.

In response to the data, the interface 65 generates and outputs not only the pulse signals indicating the insertion lengths or the drawing-out lengths of respective stubs S1, S2 and S3 to be inserted into or drawn out from the rectangular waveguide 13 but also the polarity signals indicating the insertion or the drawing-out operation thereof, to respective motor drivers **41*a*, 41*b* and 41*c*. Further, the CPU 60 calculates the progressive wave power Pi and the reflected wave power Pr of the microwave propagating in the rectangular waveguide 13 based on the data of the respective detection signals and the calculated absolute value |Γo| of the reflection coefficient Γo at the reference point, and then, outputs data of the calculated progressive wave power Pi through the interface 68 and the D/A converter 69*a* to not only the error amplifier AMP of the high voltage power source circuit 1 but also a DC ampere meter M11 for indicating the progressive wave power Pi, and also outputs data of the calculated reflected wave power Pr through the interface 68 and the D/A converter 69*b* to not only the comparator CMP1 of the high voltage power source circuit 1 but also a DC ampere meter M12 for indicating the reflected wave power Pr. It is to be noted that the impedance adjusting process and the process for calculating the progressive wave power Pi and the reflected wave power Pr and for outputting data thereof which are executed by the CPU 60 will be described in detail later, with reference to flow charts shown in FIG. 14*a***.

The display 71 displays impedance points seen looking at the reference point toward the load on a Smith chart, and the insertion lengths of respective stubs S1, S2 and S3, according to the data inputted from the CPU 60 through the display interface 63.

The keyboard 72 comprises a set of ten keys (not shown) for inputting the absolute value |Γs| and the phase θs of the reflection coefficient Γs corresponding to the desirable impedance Zs to be set, and outputs the inputted data to the CPU 60 through the keyboard interface 64.

(4) Voltage Standing Wave Detector

The voltage standing wave detector 31 comprises three probes PR1, PR2 and PR3 mounted at respective points Pda, Pdb and Pdc in the longitudinal direction of the rectangular waveguide 13 at equal spaces of λg/6, as described above.

Figure 4:
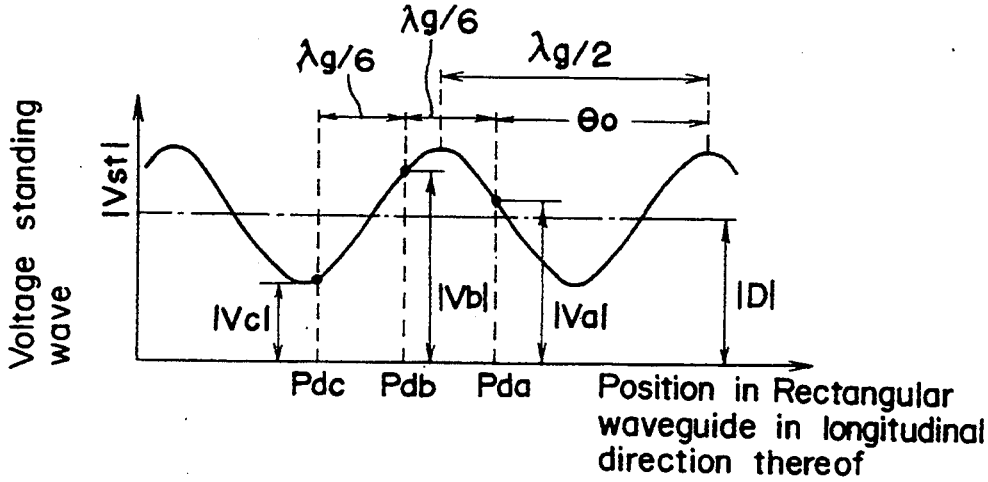
FIG. 4 is a chart showing a voltage standing wave pattern formed in a rectangular waveguide shown in FIG. 1.

FIG. 4 shows a voltage standing wave pattern |Vst| when there is a reflected wave propagating from the load end **14*t* in the rectangular waveguides 13 and 14, namely, the load impedance Ps1 seen looking toward the load at the reference point is mismatched to the impedance seen looking toward the microwave oscillator 10**.

Referring to FIG. 4, the amplitude |Vst| of the voltage standing wave changes periodically with a period of λg/2. In FIG. 4, the amplitude of the progressive wave voltage is denoted by |D|, and the amplitudes of the voltage standing wave at the points Pda, Pdb and Pdc are labeled |Va|, |Vb| and |Vc|, respectively.

Figure 5:
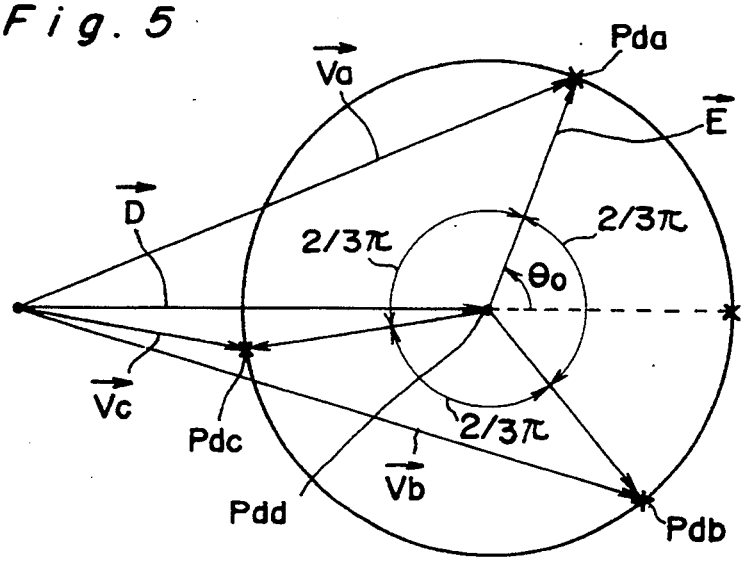
FIG. 5 is a crank diagram showing respective vectors of the voltage standing wave at mounted points of respective probes shown in FIG. 1.

FIG. 5 is a crank diagram showing a relationship among vectors $\vec{V}a$, $\vec{V}b$ and $\vec{V}c$ of the amplitudes Va, Vb and Vc of the voltage standing wave, a vector $\vec{D}$ of a progressive wave voltage D, and a vector $\vec{E}$ of a reflected wave voltage E. In FIG. 5, θo is a phase of the reflected wave voltage E relative to a point where the amplitude |Vst| of the voltage standing wave becomes a maximum. Then, the reflection coefficient Γo at the mounted point Pda of the probe PR1 is expressed as follows:

$$\Gamma o = |\Gamma o| \cdot e^{j\theta o} \tag{1}$$

Since the mounted point Pda of the probe PR1 is located apart by a distance of λg/2 in the longitudinal direction of the rectangular waveguide 13 from the reference point Ps1 at which the stub S1 is mounted, the reflection coefficient Γo expressed by the above equation (1) is a reflection coefficient at the reference point Ps1.

As shown in FIG. 5, respective vectors $\vec{V}a$, $\vec{V}b$ and $\vec{V}c$ of the amplitudes of the voltage standing wave are a sum of the vector $\vec{D}$ of the progressive wave voltage D and the vector $\vec{E}$ of the reflected voltage E. Respective end points of the vectors $\vec{V}a$, $\vec{V}b$ and $\vec{V}c$ are positioned on a circle having a radius equal to the amplitude of the vector $\vec{E}$ of the reflected wave voltage E and a center point which is located at the end point Pdd of the vector $\vec{D}$ of the progressive wave voltage D so that each difference between respective phases thereof becomes 2π/3. When the amplitude |Vst| of the voltage standing wave becomes a maximum, the phase θo becomes zero, and the reflection coefficient Γo becomes |Γo|. On the other Hand, the amplitude |Vst| of the voltage standing wave becomes a minimum, the phase θo becomes π, and the reflection coefficient Γo becomes −|Γo|.

Furthermore, as is apparent from FIG. 5, the squares of respective amplitudes of the voltage standing wave $|Va|^2$, $|Vb|^2$ and $|Vc|^2$ detected by the probes PR1, PR2 and PR3 are expressed as follows:

$$|Va|^2 = |E|^2 + |D|^2 - 2|E| \cdot |D| \cdot \cos(\pi - \theta o) \tag{2}$$

$$|Vb|^2 = |E|^2 + |D|^2 - 2|E| \cdot |D| \cdot \cos(\pi - \theta o + 4\pi/3) \tag{3}$$

$$|Vc|^2 = |E|^2 + |D|^2 - 2|E| \cdot |D| \cdot \cos(\pi - \theta o + 2\pi/3) \tag{4}$$

Furthermore, the absolute value |Γo| of the reflection coefficient Γo is expressed as follows:

$$|\Gamma o| = |E| / |D| \tag{5}$$

Therefore, since respective amplitudes |Va|, |Vb| and |Vc| of the voltage standing wave can be measured by the voltage standing wave detector 31, the absolute value |Γo| and the phase θo of the reflection coefficient Γo can be obtained by calculating the solutions of the simultaneous equations (2) to (5). Furthermore, the admittance or the impedance seen looking toward the plasma generating apparatus 30 at the reference point Ps1 can be calculated using equations (10) to (12) which are described later, based on the absolute value $|\Gamma o|$ and the phase $\theta o$.

Further, based on the respective amplitudes $|Va|$, $|Vb|$ and $|Vc|$ of the voltage standing wave and the calculated absolute value $|\Gamma o|$ of the reflection coefficient $\Gamma o$, there can be calculated the progressive wave power Pi and the reflected wave power Pr of the microwave propagating in the rectangular waveguide 13 using the following equations (6) and (7):

$$Pi = Co \cdot Pa \quad (6),$$

and $$Pr = Co \cdot Pa \cdot |\Gamma o| \quad (7),$$

where Co is a practical constant which is previously determined based on electric characteristics of the respective probes PR1, PR2 and PR3 and the diodes DI1, DI2 and DI3, and Pa is expressed by the following equation:

$$Pa = \frac{1}{6}\{|Va| + |Vb| + |Vc| + \sqrt{3} \cdot \sqrt{4 \cdot |Va| \cdot |Vb| - (|Va| + |Vb| - |Vc|)^2} \quad (8)$$

As one example of the equations for calculating the progressive wave power Pi and the reflected wave power Pr based on the respective amplitudes $|Va|$, $|Vb|$ and $|Vc|$ of the voltage standing wave and the calculated absolute value $|\Gamma o|$ of the reflection coefficient $\Gamma o$, the above equations (6) and (7) are shown above. However, the present invention is not limited to this, the progressive wave power Pi and the reflected wave power Pr may be calculated as follows. As described in detail later, since the relationship between the admittance Yo seen looking from the reference point toward the load circuit and the reflection coefficient $\Gamma o$ is expressed by the above equation (10), the progressive wave power Pi and the reflected wave power Pr may be calculated based on the amplitudes $|Va|$, $|Vb|$ and $|Vc|$ of the voltage standing wave and either one of the admittance Yo seen looking from the reference point toward the load circuit and the impedance Zo which is the reciprocal of the admittance Yo.

(5) Triple-stub Tuner

The triple-stub tuner 32 comprises three stubs S1, S2 and S3 mounted at respective points Ps1, Ps2 and Ps3 of the rectangular waveguide 13 at equal spaces of $\lambda g/4$ in the longitudinal direction thereof, as described above.

Figure 13:
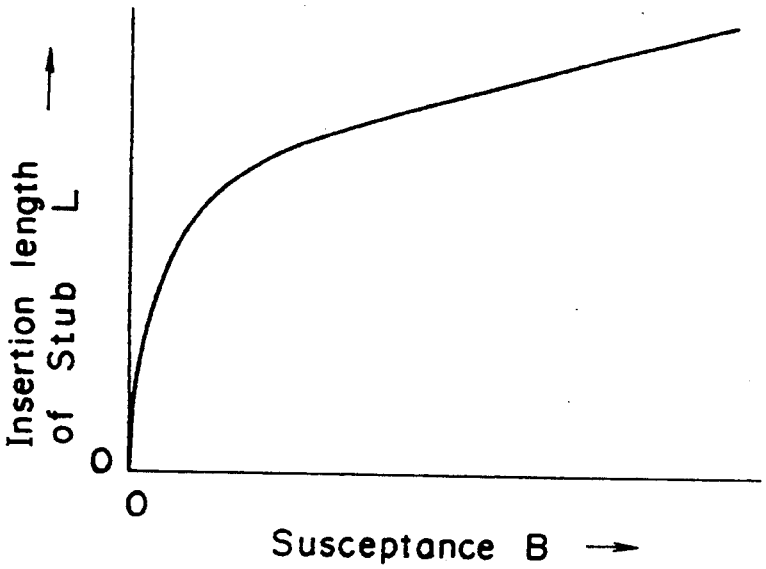
FIG. 13 is a graph showing a relationship between an insertion length of each stub of the triple-stub tuner shown in FIG. 1 when each stub is inserted into the rectangular waveguide, and a susceptance connected to the stub point.

FIG. 13 shows a relationship between an insertion length L of each of the stubs S1, S2 and S3 when being inserted into the rectangular waveguide 13, and a susceptance B connected to the mounted point of each stub in the rectangular waveguide 13.

As is apparent from FIG. 13, as the insertion length L of each of the stubs S1, S2 and S3 increases, the susceptance B of the mounted point increases. Namely, each of the stubs S1, S2 and S3 operates as an admittance element having a pure susceptance B.

Figure 6:
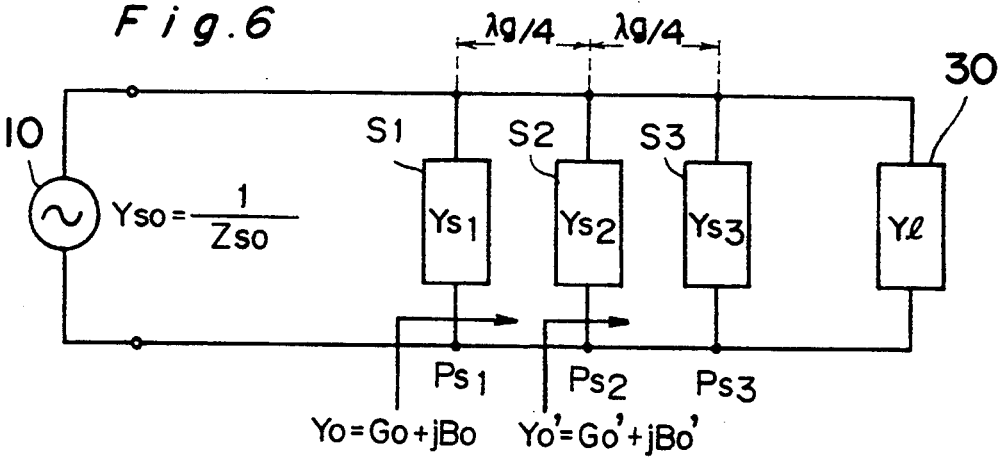
FIG. 6 is a circuit diagram showing an equipment circuit of a triple-stub tuner arranged between the microwave oscillator and a plasma generating apparatus shown in FIG. 1.

FIG. 6 shows an equivalent circuit of the triple-stub tuner 32 which is connected between the microwave oscillator 10 and the plasma generating apparatus 30.

Referring to FIG. 6, the microwave oscillator 10, respective admittance elements Ys1, Ys2 and Ys3 of the stubs S1, S2 and S3, and a load admittance Yl of the plasma generating apparatus are connected in parallel. The respective stubs S1, S2 and S3 are mounted apart by $\lambda g/4$ from each other, and equivalently acts as a microwave network composed of admittance or impedance variable elements. Therefore, the triple-stub tuner 32 can adjust the admittance $Yo = Go + jBo$ seen looking toward the load of the plasma generating apparatus 30 at the reference point Ps1 where the stub S1 is mounted, to a desirable admittance $Ys = 1/Zs$.

For example, in order to match the load admittance Yo seen looking toward the plasma generating apparatus 30 to the admittance of the microwave oscillator 10, it is apparent that the stubs S1, S2 and S3 are respectively inserted into the rectangular waveguide 13 by such insertion lengths that the admittance Yo seen looking toward the plasma generating apparatus 30 at the reference point Ps1 is matched to the admittance $Yso = 1/Zso$ seen looking toward the microwave oscillator 10 at the reference point Ps1.

In the microwave power source apparatus of the present preferred embodiment, there is calculated the insertion lengths of respective stubs S1, S2 and S3 required for adjusting the admittance Yo seen looking toward the load of the plasma generating apparatus 30 at the reference point Ps1 to a desirable admittance Ys including the admittance Yso seen looking toward the microwave oscillator 10 at the reference point Ps1, by the CPU 60 of the controller 50, and then, the stepping motors M1, M2 and M3 are driven so that the stubs S1, S2 and S3 are inserted into the rectangular waveguide 13 by the calculated insertion lengths, respectively.

Figure 7:
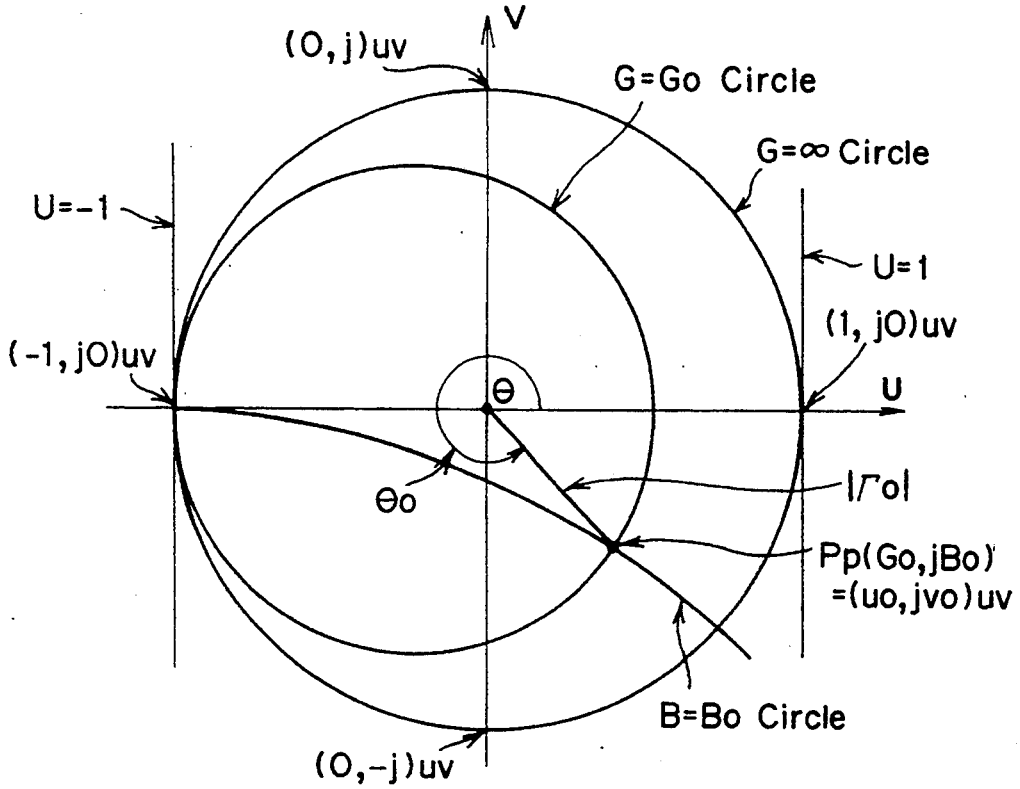
FIGS. 7 and 8 are reflection coefficient charts and Smith charts showing an admittance contour on these charts when stubs S1, S2 and S3 of the triple-stub tuner shown in FIG. 1 are inserted into and drawn out from the rectangular waveguide.

FIG. 7 shows a relationship between a Smith chart and a UV orthogonal coordinates (referred to as a UV coordinates hereinafter) of a complex plane of a reflection coefficient $\Gamma$.

As shown in FIG. 7, the reflection coefficient $\Gamma o$ at the reference point Ps1 is expressed as follows:

$$\Gamma o = |\Gamma o| \cdot e^{j\theta o} = u_o + jv_o \quad (9)$$

where $u_o$ and $v_o$ are a coordinate value of the U-axis and a coordinate value of the V-axis of the UV coordinates, respectively.

Furthermore, the admittance $Yo = 1/Zo$ seen looking toward the load of the plasma generating apparatus 30 at the reference point Ps1 is uniquely expressed as follows:

$$\begin{aligned} Yo &= Go + jBo \\ &= (1 - |\Gamma o| \cdot e^{j\theta o})/(1 + |\Gamma o| \cdot e^{j\theta o}) \\ &= (1 - u_o - jv_o)/(1 + u_o + jv_o) \end{aligned} \quad (10)$$

An admittance point Pp of the admittance Yo is shown on the Smith chart and the UV coordinates of FIG. 7. Furthermore, the conductance Go and the susceptance Bo of the admittance Yo are uniquely expressed as follows:

$$Go = (1 - u_o^2 - v_o^2) / \{(1 + u_o)^2 + v_o^2\} \quad (11)$$

$$Bo = -2v_o / \{(1 + u_o)^2 + v_o^2\} \quad (12)$$

Furthermore, transforming the above equations (11) and (12) gives:

$$\{u_o+Go/(Go+1)\}^2+vo^2=\{1/(Go+1)\}^2 \quad (13)$$

$$(u_o+1)^2+(v_o+1/Bo)^2=(1/Bo)^2 \quad (14)$$

The above equation (13) represents a G=Go circle which includes the admittance point Pp on the Smith chart and is tangent to a U=−1 straight line, as shown in FIG. 7. Also, the above equation (14) represents a B=Bo circle which includes the admittance point Pp on the Smith chart and a point of the UV coordinates (−1, j0)uv, as shown in FIG. 7.

It is to be noted that, in the specification and FIGS. 7 to 12, UV coordinates of an admittance point located on the Smith chart are represented hereinafter by a coordinate representation with a suffix "uv" such as (0, j)uv, (1, j0)uv, and also, coordinates of an admittance point located on the Smith chart which indicate a conductance and a susceptance thereof is represented hereinafter by a coordinate representation without any suffix such as (Go, jBo).

When the insertion length of either the stub S1 located at the reference point Ps1 or the stub S3 located at the point Ps3 apart from the reference point Ps1 by a distance of λg/2 in the longitudinal direction of the rectangular waveguide 13 is changed, only the susceptance B to be connected to the point Ps1 or Ps3 of the rectangular waveguide 13 changes, as described above. Therefore, when the insertion length of the stub S1 or S3 of the triple-stub tuner 32 is changed, the admittance point Pp of the admittance Yo seen looking toward the load of the plasma generating apparatus 30 at the point Ps1 or Ps3 moves on the G=Go circle on the Smith chart shown in FIG. 7.

Figure 8:
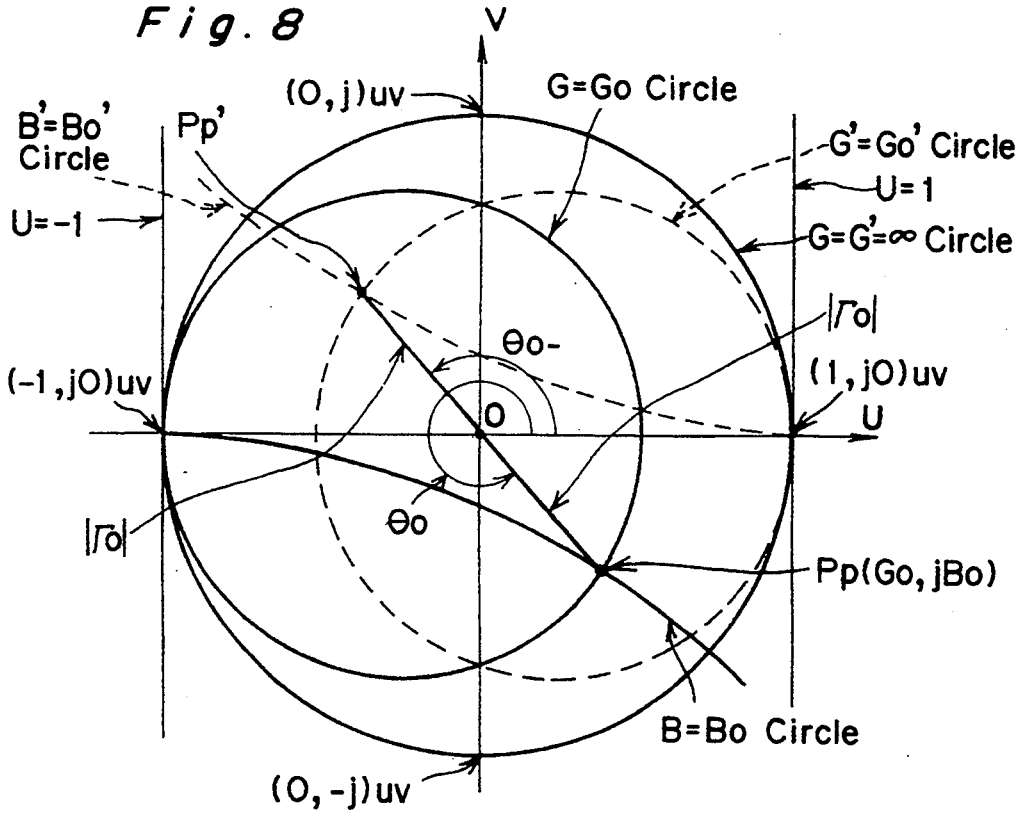

Furthermore, as shown in FIG. 8, an admittance point of an admittance Yo′ seen looking toward the load of the plasma generating apparatus 30 at the point Ps2 of the stub S2 is located at a point Pp′ given when the admittance point Pp of the admittance Yo on the Smith chart is rotated around the original 0 of the UV coordinates by 180 degrees, and the admittance Yo′ is uniquely expressed as follows:

$$\begin{aligned} Yo' &= Go' + jBo' \\ &= (1+|\Gamma o|\cdot e^{j\theta o})/(1-|\Gamma o|\cdot e^{j\theta o}) \\ &= (1+u_o+jv_o)/(1-u_o-jv_o) \end{aligned} \quad (15)$$

It is to be noted that respective references of an admittance, a conductance and a susceptance seen looking toward the load of the plasma generating apparatus 30 are suffixed with a dash mark ′ so as to distinguish them from those seen looking toward the load at the reference point PS1.

Further, the conductance Go′ and the susceptance Bo′ of the admittance Yo′ are uniquely expressed as follows:

$$Go'=(1-u_{o2}-v_{o2})/\{(1-u_o)^2+v_o^2\} \quad (16)$$

$$Bo'=2v_o/\{(1-u_o)^2+v_o^2\} \quad (17)$$

Furthermore, transforming the above equations (16) and (17) gives:

$$\{u_o-Go'/(Go'+1)\}^2+v_o^2=\{1/(Go'+1)\}^2 \quad (18)$$

$$(u_o-1)^2+(v_o-1/Bo')^2=(1/Bo')^2 \quad (19)$$

The above equation (18) represents a G′=Go′ circle which includes the admittance point Pp′ on the Smith chart and is tangent to a U=1 straight line, as shown in FIG. 8, and the G′=Go′ circle and the G=Go circle are point symmetric with respective to the origin 0 of the UV coordinates. Also, the above equation (19) represents a B′=Bo′ circle which includes the admittance point Pp′ on the Smith chart and a point of the UV coordinates (1, j0)uv, as shown in FIG. 8, and the B′=Bo′ circle and the B=Bo circle are point symmetric with respective to the origin 0 of the UV coordinates.

It is to be noted that, in FIGS. 7 to 12, the coordinates of the Smith chart are represented by coordinates of an admittance point of an admittance seen looking toward the load at the reference point Ps1. Furthermore, in all FIGS. 7 to 12, a G=G′=∞ circle which includes points of the UV coordinates (1, j0)uv, (0, j)uv, (−1, j0)uv and (0, −j)uv is drawn as a maximum reference circle.

When the insertion length of the stub S2 located at the point Ps2 of the rectangular waveguide 13 is changed, only the susceptance B to be connected to the point Ps2 of the rectangular waveguide 13 changes, as described above. Therefore, when the insertion length of the stub S2 of the triple-stub tuner 32 is changed, the admittance point Pp′ of the admittance Yo′ seen looking toward the load of the plasma generating apparatus 30 at the points Ps2 moves on the G′=Go′ circle on the Smith chart shown in FIG. 8.

In the impedance adjusting process executed by the CPU 60 of the controller 50 as described later, the susceptance Bo′ of the admittance Yo′ seen looking toward the load at the point Ps2 of the stub S2 is calculated from the UV coordinates of the admittance point Po of the admittance Yo seen looking toward the load at the reference point Ps1, and also, the susceptance Bo of the admittance Yo seen looking toward the load at the reference point Ps1 is calculated from the UV coordinates of the admittance point Pp′ of the admittance Yo′ seen looking toward the load at the point Ps2 of the stub S2. In these calculations, the converted susceptance can be calculated by inverting respective signs of the coordinate values of the U-axis and V-axis and substituting the inverted UV coordinates into the equation (12).

(5) Action of Microwave Power Source Apparatus

Figure 14A:
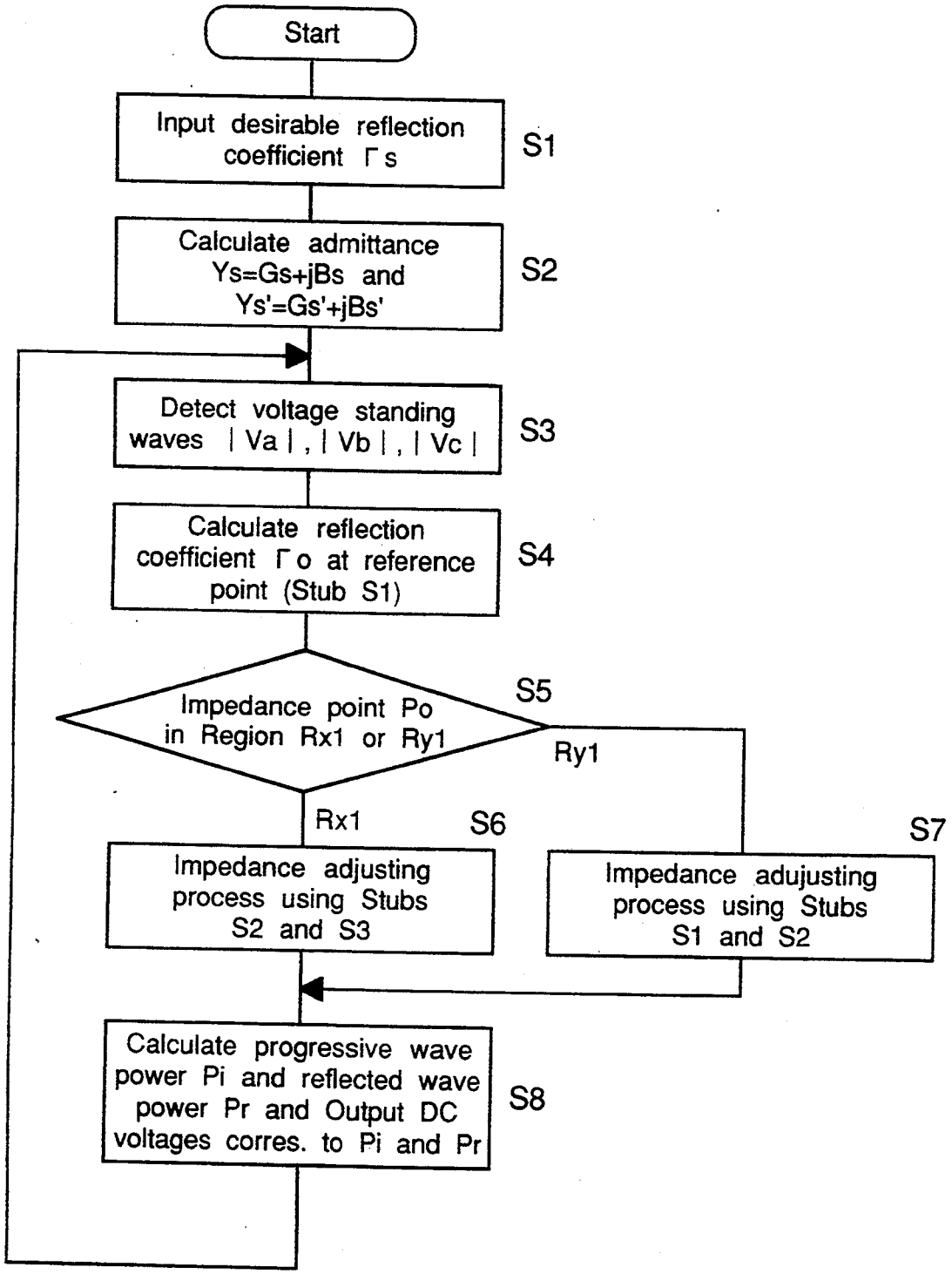
FIG. 14*a* is a flow chart showing an automatic impedance adjusting process executed by the controller shown in FIGS. 1 and 3.

FIG. 14*a* is a flow chart showing the automatic impedance adjusting process and the process for calculating the progressive wave power Pi and the reflected wave power Pr of the microwave outputted from the microwave oscillator 10 and outputting data thereof which are executed by the CPU 60 of the controller 50.

Figure 9:
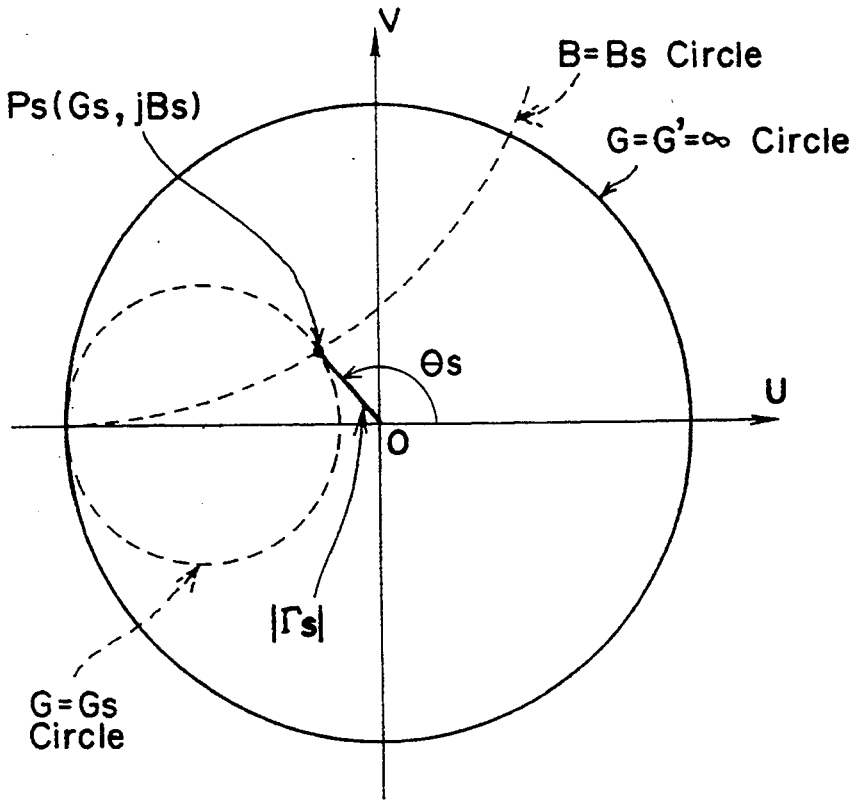
FIGS. 9 to 12 are reflection coefficient charts and Smith charts showing actions of the microwave power source apparatus shown in FIGS. 1 to 3.

Referring to FIG. 14*a*, first of all, at step S1, an absolute value |Γs| and a phase θs of a desirable reflection coefficient Γs corresponding to a desirable impedance Zs seen looking toward the load at the reference point Ps1 are inputted using a set of ten keys of the keyboard 72. Thereafter, at step S2, the CPU 60 calculates a conductance Gs and a susceptance Bs of a desirable admittance Ys corresponding to the inputted reflection coefficient Γs, using the equations (10) to (12) based on the absolute value |Γs| and the phase θs of the reflection coefficient Γs which have been inputted, wherein the admittance point of the desirable admittance Ys is located at an intersection Ps of the G=Gs circle and the B=Bs circle on the Smith chart, as shown in FIG. 9.

Thereafter, there are calculated a conductance Gs' and a susceptance Bs' of an admittance Ys' seen looking toward the load at the point Ps2 of the stub S2 which is given when the phase of the desirable admittance Ys is inverted, using the equations (16) and (17).

Figure 10:
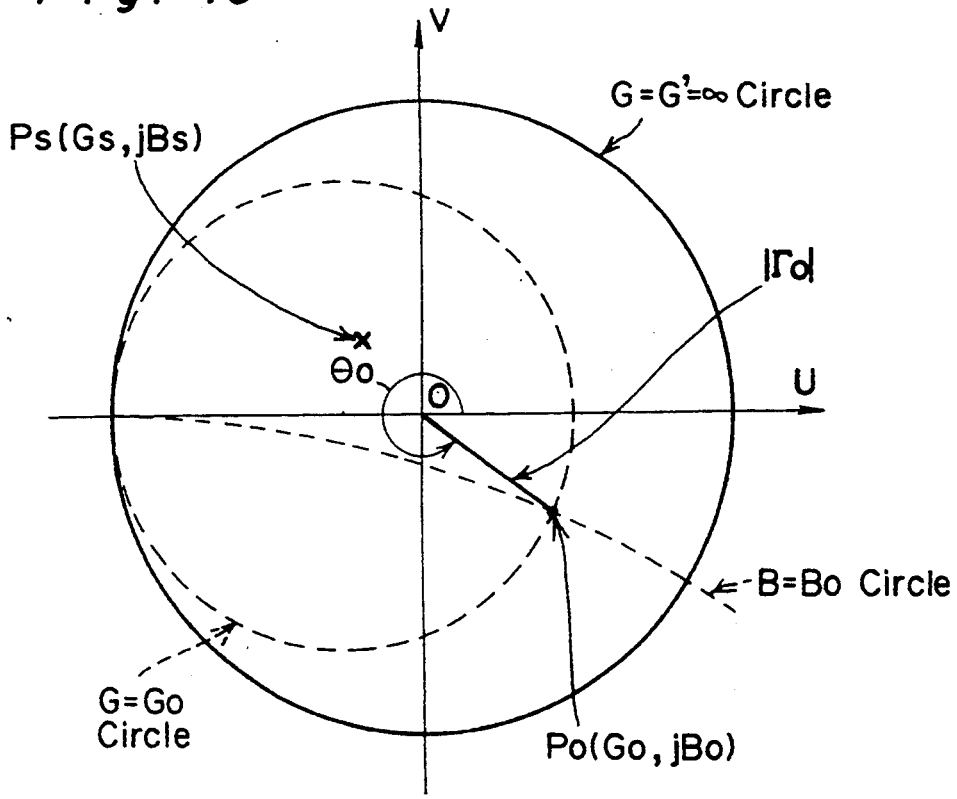

Furthermore, at step 3, after the above-mentioned linear correction process is performed for the respective DC voltages detected by the diodes DI1, DI2 and DI3 which are respectively connected to the probes PR1, PR2 and PR3 of the voltage standing wave detector 31, there are calculated the amplitudes of the voltage standing wave |Va|, |Vb| and |Vc| based on the respective corrected voltages. Thereafter, at step S4, there are calculated the absolute value |Γo| and the phase θo of the reflection coefficient Γo at the reference point Ps1 by calculating the solutions of the simultaneous equations (2) to (5). It is to be noted that the admittance point of the admittance (referred to as a reference admittance hereinafter) Yo corresponding to the calculated reflection coefficient Γs at the reference point Ps1 is located at an intersection Po of the G=Go circle and the B=Bo circle on the Smith chart, as shown in FIG. 10.

Figure 11:
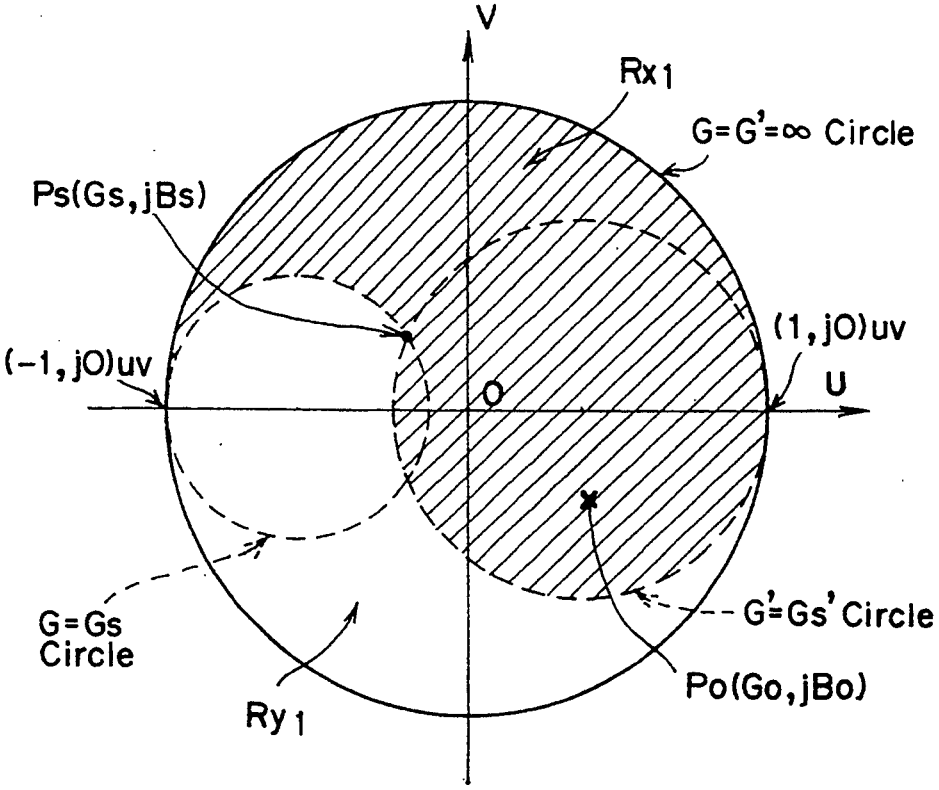
Figure 12:
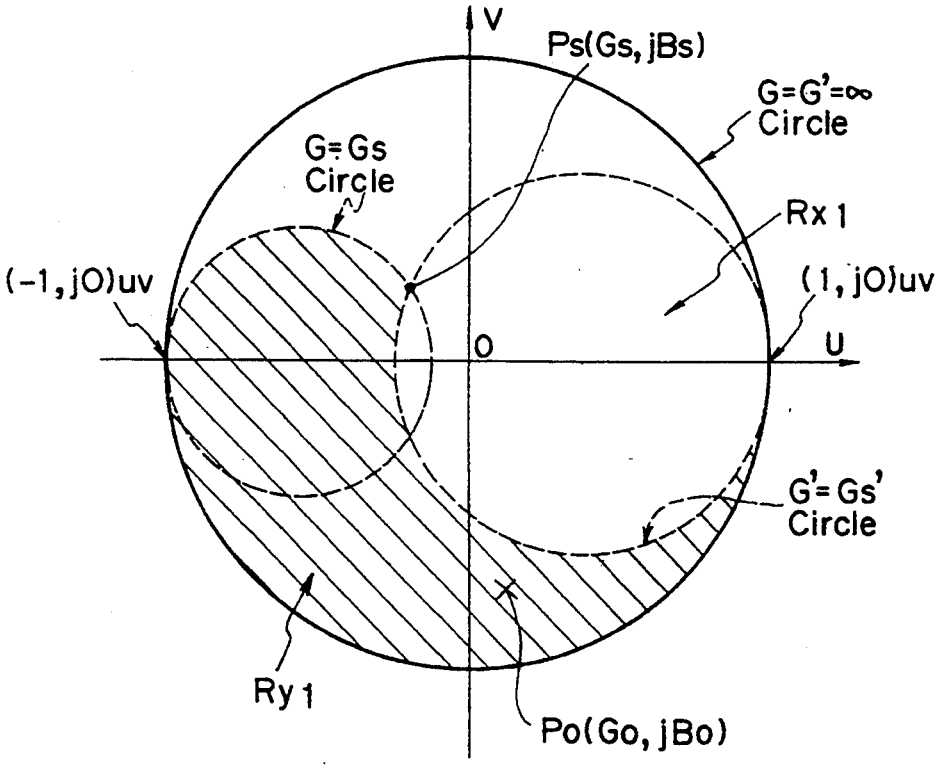

Thereafter, at step S5, it is judged whether the admittance point Po of the reference admittance Yo detected by the voltage standing wave detector 31 is located within a tuning region Rx1 shown by a hatching in FIG. 11, or within a tuning region Ry1 shown by a hatching in FIG. 12. Then, if the admittance point Po is located within the tuning region Rx1, the program flow goes to step S6, and then, the impedance adjusting process using the stubs S2 and S3 is executed so as to adjust the reference admittance Yo to the above desirable admittance Ys in a manner similar to that known to those skilled in the art, and the program flow goes to step S8. On the other hand, if the admittance point Po is located within the tuning region Ry1, the program flow goes to step S7, and then, the impedance adjusting process using the stubs S1 and S2 is executed so as to adjust the reference admittance Yo to the above desirable admittance Ys in a manner similar to that known to those skilled in the art, and the program flow goes to step S8.

As shown in FIG. 11, the tuning region Rx1 is a region located within the G=G'=∞, and is composed of a sum of:

(a) a region located within a G'=Gs' circle which includes the admittance point Ps of the admittance Ys on the Smith chart, and is tangent to the U=1 straight line; and (b) a region of all the positive coordinate of the V-axis of the UV coordinates given excluding a region located within a G=Gs circle which includes the admittance point Ps and is tangent to the U=−1 straight line. If the admittance point Po of the reference admittance Yo on the Smith chart is located in the tuning region Rx1, the reference admittance Yo can be adjusted to the desirable admittance Ys using two stubs S2 and S3.

Furthermore, as shown in FIG. 12, the tuning region Ry1 is a region located within the G=G'=∞ given excluding the tuning region Rx1. If the admittance point Po of the reference admittance Yo is located in the tuning region Ry1 on the Smith chart, the reference admittance Yo can be adjusted to the desirable admittance Ys using two stubs S1 and S1.

It is to be noted that, if the admittance point Po is located on the G=Gs circle of a boundary line between the tuning regions Rx1 and Ry1 shown in FIGS. 11 and 12, the above impedance adjusting process can be executed using only either one of the stubs S1 and S3. On the other hand, if the admittance point Po is located on the G'=Gs' circle of a boundary line between the tuning regions Rx1 and Ry1 shown in FIG. 11 and 12, the above impedance adjusting process can be executed using only the stub S2.

Furthermore, at step S8, based on the calculated amplitudes of the respective voltage standing wave |Va|, |Vb| and |Vc| and the absolute value |Γo| of the reflection coefficient Γo, the CPU 60 calculates the progressive wave power Pi and the reflected wave power Pr of the microwave propagating in the rectangular waveguide 13 outputted from the microwave oscillator 10, and thereafter, the CPU 60 outputs data of the calculated progressive wave power Pi and the calculated reflected wave power Pr through the D/A converters 69*a* and 69*b* to the error amplifier AMP and the comparator CMP1 of the high voltage power source circuit 1, respectively. Then, as shown in FIG. 2, the error amplifier AMP subtracts the DC voltage directly proportional to the progressive wave power Pi from the DC voltage directly proportional to the desirable adjustment value of the progressive wave power outputted from the DC power source 8 for setting it, amplifies the difference voltage therebetween and outputs it through the driving amplifier DA to the base of the transistor TR for the series regulator. Therefore, the current of the anode power source supplied to the magnetron MG of the microwave oscillator 10 is controlled, and the output power of the microwave outputted from the magnetron MG of the microwave oscillator 10 or the progressive wave Pi of the microwave propagating in the rectangular waveguide 13 is adjusted to the desirable adjustment value thereof set using the variable resistor VR.

After the process of step S8, the program flow goes to step S3, and then, the processes of steps S3 to S8 are repeatedly performed. Since the processes of steps S3 to S8 are repeatedly performed, even though the load impedance of the load circuit changes, both of the automatic impedance adjusting process and the process for automatically adjusting the output power of the microwave oscillator 10 can be performed according to the change in the load impedance.

Figure 14B:
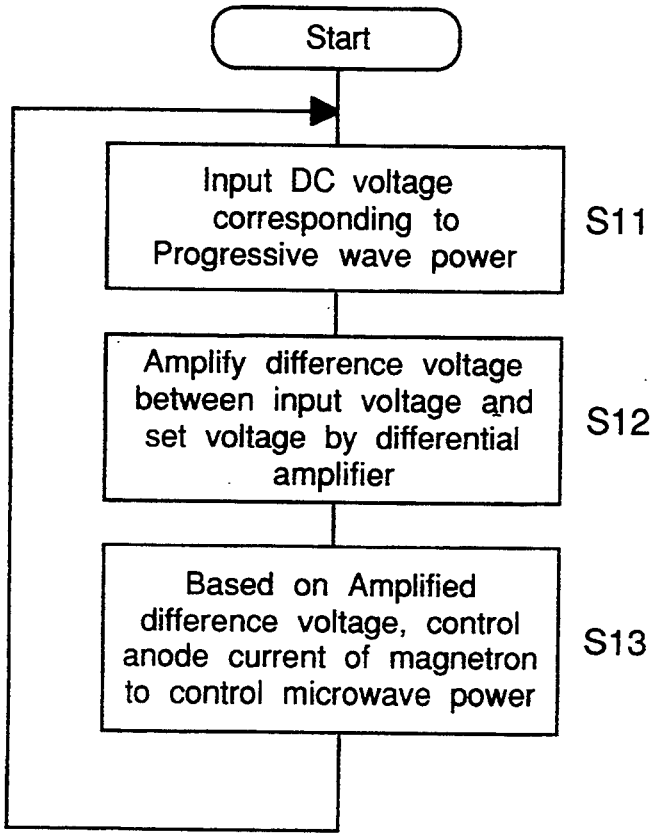
FIG. 14*b* is a flow chart showing an automatic output power adjusting process executed by the high voltage power source circuit shown in FIG. 1.

As described above, in the above-mentioned microwave power source apparatus comprising the controller 50 and the high voltage power source circuit 1, both of the process of the controller 50 shown in FIG. 14*a* and the process of the high voltage power source circuit 1 shown in FIG. 14*b* are performed at the same time. In particular, the microwave power source apparatus of the present preferred embodiment is characterized in performing the process of the high voltage power source circuit 1 shown in FIG. 14*b* based on the progressive wave power Pi calculated in the process shown in FIG. 14*a* by the CPU 60 of the controller 50.

Further, in order to match the impedance seen looking toward the microwave oscillator 10 to the impedance seen looking toward the load of the plasma generating apparatus 30, at step S2, "zero" and "any number" are inputted as the absolute value |Γs| and the phase θs of the reflection coefficient Γs, respectively.

As is apparent from comparison between FIGS. 1 and 15, in the above-mentioned microwave power source apparatus, it is unnecessary to provide the directional coupler 102, and then, the microwave power source apparatus of the present preferred embodiment has a structure simpler than that of the conventional apparatus shown in FIG. 15. In other words, the microwave power source apparatus can be miniaturized and be made lighter as compared with the conventional apparatus.

Furthermore, in the present preferred embodiment, since the linear correction process is performed by the CPU 60, it is unnecessary to provide the conventional linear correction circuits 131 and 132.

(7) Modifications

In the present preferred embodiment, the apparatus for executing the impedance adjusting process including the impedance matching process in the microwave transmission line 13 of the rectangular waveguide is described. However, the present invention is not limited to this. The present invention can be applied to an automatic microwave impedance adjusting apparatus for adjusting an impedance seen looking toward a microwave load in the other kinds of microwave transmission lines such as a microstrip line, a slot line, a coplanar line or the like.

In the voltage standing wave detector 31 of the present preferred embodiment, three probes PR1, PR2 and PR3 are mounted at equal spaces of $\lambda g/6$ in the longitudinal direction of the rectangular waveguide 13. However, the present invention is not limited to this. At least three probes may be mounted at different points at predetermined spaces, one of which is not a product of any natural number and the length $\lambda g/2$. Each space between the probes is preferably set at a length equal to a product of any natural number and the length $\lambda g/6$ except for products of any natural number and the length $\lambda g/2$. For example, when each space between the probes is set at the length $\lambda g/3$, the squares of the amplitudes of the voltage standing wave detected by respective probes PR1, PR2 and PR3 are expressed as follows:

$$|Va|^2=|E|^2+|D|^2-2|E|\cdot|D|\cdot\cos(\pi-\theta o) \quad (20)$$

$$|Vb|^2=|E|^2+|D|^2-2|E|\cdot|D|\cdot\cos(\pi-\theta o+8\pi/3) \quad (21)$$

$$|Vc|^2=|E|^2+|D|-2|E|\cdot|D|\cdot\cos(\pi-\theta o+4\pi/3) \quad (22)$$

In the present preferred embodiment, the space in the longitudinal direction of the rectangular waveguide 13 between the stub S1 and the probe PR1 is set at the length $\lambda g/2$ for convenience of the explanation. However, the present invention is not limited to this. This space may be set at any distance.

In the present preferred embodiment, there are provided three stubs S1, S2 and S3 as susceptance elements to be connected to the transmission line of the rectangular waveguide 13. However, the present invention is not limited to this. The other kinds of microwave variable susceptance element may be used. A susceptance to be connected thereto may be changed using at least two stubs depending on a desirable impedance or a desirable admittance seen looking toward a load at a reference point of a microwave transmission line.

Furthermore, in the present preferred embodiment, three stubs S1, S2 and S3 are mounted at equal spaces of $\lambda g/4$ in the longitudinal direction of the rectangular waveguide 13. However, the present invention is not limited to this. These stubs S1, S2 and S3 may be mounted at different points at predetermined spaces in the longitudinal direction of the rectangular waveguide 13 so that the spaces other than one space therebetween are not a product of any natural number and the length $\lambda g/2$.

At step S1 of FIG. 20 of the present preferred embodiment, there are inputted the absolute value $|\Gamma s|$ and the phase $\theta s$ of the reflection coefficient $\Gamma s$ corresponding to the desirable impedance Zs seen looking toward the load at the reference point Ps1. However, the present invention is not limited to this. A resistance Rs and a reactance Xs of a desirable impedance Zs may be inputted, or a conductance Gs and a susceptance Bs of a desirable admittance Ys corresponding to a desirable impedance Zs may be inputted.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A microwave power source apparatus comprising:

a microwave oscillator for generating a microwave;

a microwave transmission line connected between said microwave oscillator and a microwave load, said microwave transmission line being a waveguide;

power source means for supplying an electric power for generating said microwave to said microwave oscillator;

measuring means, mounted on said microwave transmission line, for detecting a voltage standing wave of said microwave being generated by said microwave oscillator and propagating on said microwave transmission line and for measuring either one of an impedance seen looking toward said microwave load at a mounted point thereof and a reflection coefficient thereat based on said detected voltage standing wave, said measuring means comprising at least three probes mounted at different points at predetermined spaces in the longitudinal direction of said waveguide so that each of said spaces therebetween is not set at a product of any natural number and half a guide wavelength of said microwave propagating in said waveguide;

first calculating means for calculating an incident wave power and a reflected wave power of said microwave propagating on said microwave transmission line from said microwave oscillator toward said microwave load based on either one of said impedance and said reflection coefficient measured by said measuring means;

first control means for controlling said power source means to adjust said incident wave power of said microwave to a predetermined desirable adjustment value based on said incident wave power calculated by said first calculating means;

comparator means for judging whether or not said reflected wave power calculated by said first calculating means is larger than a predetermined threshold power value; and output switch means for preventing said power source means from supplying the electric power to said microwave oscillator when it is judged by said comparator means that said reflected wave power calculated by said first calculating means is larger than said predetermined threshold power value.

2. The apparatus as claimed in claim 1, further comprising:

variable impedance means for changing an impedance to be connected to a mounted point thereof, said variable impedance means being mounted on said microwave load side of said measuring means on said microwave transmission line, said variable impedance means comprising at least two stubs mounted at different points on said waveguide; and second control means for controlling said variable impedance means in response to either one of said impedance and said reflection coefficient measured by said measuring means so as to adjust said impedance seen looking toward said microwave load to a predetermined desirable second adjustment value, said second control means comprising second calculating means for calculating said impedance of said variable impedance means to be connected to said mounted point thereof required for adjusting said impedance seen looking toward said microwave load to said predetermined desirable second adjustment value, in response to either one of said impedance and said reflection coefficient measured by said measuring means, and data outputting means for outputting data representing said calculated impedance to said variable impedance means.

3. The apparatus as claimed in claim 1, further comprising:

first displaying means for displaying the incident wave power calculated by said first calculating means; and second displaying means for displaying the reflected wave power calculated by said first calculating means.

4. The apparatus as claimed in claim 1, further comprising:

first displaying means for displaying the incident wave power calculated by said first calculating means; and second displaying means for displaying the reflected wave power calculated by said first calculating means.

5. The apparatus as claimed in claim 2, wherein said microwave transmission line is a rectangular waveguide, and said variable impedance means comprises at least two stubs mounted at different points at predetermined spaces in the longitudinal direction of said rectangular waveguide so that said spaces other than one space therebetween are not set at a product of any natural number and half a guide wavelength of said microwave propagating on said microwave transmission line.

6. The apparatus as claimed in claim 2, wherein said variable impedance means comprises three stubs mounted at different points at equal spaces of a quarter of said guide wavelength in the longitudinal direction of said rectangular waveguide.

7. The apparatus as claimed in claim 5, wherein said second control means further comprises:

calculating means for calculating respective insertion lengths of said stubs to be inserted into said rectangular waveguide required for adjusting said impedance seen looking toward said microwave load to said predetermined desirable second adjusting value, in response to either one of said impedance and said reflection coefficient measured by said measuring means; and data outputting means for outputting data representing said calculated insertion lengths to said variable impedance means.

8. The apparatus as claimed in claim 6, wherein said second control means further comprises:

calculating means for calculating respective insertion lengths of said stubs to be inserted into said rectangular waveguide required for adjusting said impedance seen looking toward said microwave load to said predetermined desirable second adjusting value, in response to either one of said impedance and said reflection coefficient measured by said measuring means; and data outputting means for outputting data representing said calculated insertion lengths to said variable impedance means.

9. A control method for a microwave power source apparatus comprising a microwave oscillator for generating a microwave based on an electric power generated by power source means, including the following steps of:

measuring either one of an impedance seen looking toward a microwave load at a mounted point thereof on a microwave transmission line connected between said microwave oscillator and said microwave load and a reflection coefficient thereat by detecting a voltage standing wave of said microwave being generated by said microwave oscillator and propagating on said microwave transmission line;

calculating an incident wave power and a reflected wave power of said microwave on said microwave transmission line from said microwave oscillator toward said microwave load based on said measured either one of said impedance and said reflection coefficient;

controlling a power source means for supplying electric power for generating said microwave to said microwave oscillator, so as to adjust said incident wave power of said microwave to a predetermined desirable first adjustment value based on said calculated incident wave power;

controlling variable impedance means for changing an impedance to be connected to a mounted point thereof mounted on said microwave transmission line, in response to either one of said measured impedance and said measured reflection coefficient so as to adjust said impedance seen looking toward said microwave load to a predetermined desirable second adjustment value;

judging whether or not said calculated reflected wave power is larger than a predetermined threshold power value; and preventing said power source means from supplying the electric power to said microwave oscillator when it is judged that said calculated reflected wave power is larger than said predetermined threshold power value.

10. The method as claimed in claim 9, wherein said variable impedance means controlling step includes the following steps:

calculating said impedance of said variable impedance means to be connected to said mounted point thereof required for adjusting said impedance seen looking toward said microwave load to said predetermined desirable second adjustment value, in response to said measured either one of said impedance and said reflection coefficient; and outputting data representing said calculated impedance to said variable impedance means.

* * * * *

UNITED STATES PATENT AND TRADEMARK OFFICE

CERTIFICATE OF CORRECTION

PATENT NO. : 5,399,977

DATED : March 21, 1995

INVENTOR(S) : Yuji Yashizako, et al.

It is certified that error appears in the above-indentified patent and that said Letters Patent is hereby corrected as shown below:

Column 12, line 46: "are inputted" should read --input--.

Column 16, line 45: "Hand" should read --hand--

Column 17, line 29:

" $\sqrt{4 \cdot |Va| \cdot |Vb| - (|Va| + |Vb| - |Vc|)^2}$ " should read

-- $\sqrt{4 \cdot |Va| \cdot |Vb| - (|Va| + |Vb| - |Vc|)^2}$ } --

Column 19, line 59: " $v_o^{2}\}$ " should read -- $v_o^2$ } --

Column 23, line 43: " $|D| - 2|E|$ " should read

-- $|D|^2 - 2|E|$ --

Signed and Sealed this

Ninth Day of July, 1996

Bruce Lehman

*Attest:*

BRUCE LEHMAN

*Attesting Officer*

*Commissioner of Patents and Trademarks*